US010947660B2

(12) United States Patent
Lin et al.

(10) Patent No.: US 10,947,660 B2
(45) Date of Patent: Mar. 16, 2021

(54) PORTABLE STAIN REMOVAL DEVICE

(71) Applicant: KONINKLIJKE PHILIPS N.V., Eindhoven (NL)

(72) Inventors: Shenghuai Calvin Lin, Singapore (SG); Chien-Ping Adrian Koh, Singapore (SG); Palani Pandurangan, Villupuram (IN); Hee Poh Sin, Singapore (SG); Lihong Zhao, Singapore (SG); Yong Jiang, Singapore (SG); Yile Liao, Singapore (SG)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/344,818

(22) PCT Filed: Oct. 31, 2017

(86) PCT No.: PCT/EP2017/077907
§ 371 (c)(1),
(2) Date: Apr. 25, 2019

(87) PCT Pub. No.: WO2018/083096
PCT Pub. Date: May 11, 2018

(65) Prior Publication Data

US 2020/0056320 A1 Feb. 20, 2020

(30) Foreign Application Priority Data

Nov. 1, 2016 (EP) ..... 16196680
Aug. 7, 2017 (EP) ..... 17185128

(51) Int. Cl.
*D06F 43/00* (2006.01)
*D06F 87/00* (2006.01)
(Continued)

(52) U.S. Cl.
CPC ..... *D06F 43/002* (2013.01); *C11D 11/0017* (2013.01); *C11D 17/046* (2013.01);
(Continued)

(58) Field of Classification Search
None
See application file for complete search history.

(56) References Cited

U.S. PATENT DOCUMENTS 2,987,906 A 6/1961 Bourland
3,416,879 A 12/1968 Sookne
(Continued)

FOREIGN PATENT DOCUMENTS

AU 2004284267 B2 2/2010
AU 2013222056 A1 3/2014
(Continued)

OTHER PUBLICATIONS

English text machine translation of Fujiwara et al. (JP 2016-165527 A1), accessed from Espacenet webpage, PDF pp. 1-40. (Year: 2016).*

(Continued)

*Primary Examiner* — Katie L. Hammer

(57) ABSTRACT

Portable stain removal device (1) comprising a detachable stain removal accessory (171) containing a stain removing material (300), whereby said portable stain removal device is suitable for implementing any combination of the following functions: stain removing using a chemical reagent, rinsing the stain residues and chemical residues, and evaporating water from the treated area of the garment.

20 Claims, 24 Drawing Sheets

(51) Int. Cl.

| | |
|---|---|
| ***C11D 17/04*** | (2006.01) |
| ***C11D 11/00*** | (2006.01) |
| *B08B 7/00* | (2006.01) |

(52) U.S. Cl.

CPC ..... *D06F 87/00* (2013.01); *B08B 7/0035* (2013.01); *B08B 7/0071* (2013.01)

(56) References Cited

U.S. PATENT DOCUMENTS

| | | | | |
|---|---|---|---|---|
| 3,528,115 | A | 9/1970 | Lawes | |
| 4,130,392 | A | 12/1978 | Diehl | |
| 5,872,090 | A | 2/1999 | You | |
| 6,030,464 | A | 2/2000 | Azevedo | |
| 6,048,368 | A | 4/2000 | Tcheou | |
| 6,277,808 | B1 | 8/2001 | Tcheou | |
| 6,514,924 | B1 | 2/2003 | Van Hauwermeiren | |
| 7,469,703 | B2 | 12/2008 | France | |
| 7,631,386 | B1 | 12/2009 | Santiago | |
| 7,832,041 | B2 | 11/2010 | Smith | |
| 2002/0178511 | A1* | 12/2002 | Goldoni | C11D 17/041 8/158 |
| 2005/0059571 | A1 | 3/2005 | Mahdessian | |
| 2006/0207052 | A1* | 9/2006 | Tran | A47L 13/26 15/320 |
| 2007/0051391 | A1 | 3/2007 | Wolff | |
| 2007/0107150 | A1 | 5/2007 | Smith | |
| 2007/0267049 | A1 | 11/2007 | Righetto | |
| 2008/0222817 | A1 | 9/2008 | Myhra | |
| 2011/0139180 | A1 | 6/2011 | Williams | |
| 2014/0259478 | A1* | 9/2014 | Conrad | A47L 11/4083 15/98 |
| 2015/0292132 | A1 | 10/2015 | Lee | |
| 2017/0356121 | A1* | 12/2017 | Perry | B08B 7/0071 |

FOREIGN PATENT DOCUMENTS

| | | | |
|---|---|---|---|
| AU | 2013222057 | A1 | 3/2014 |
| CA | 2538896 | C | 2/2011 |
| CN | 104088122 | A | 10/2014 |
| EP | 2172587 | A2 | 4/2010 |
| EP | 2032014 | B1 | 8/2011 |
| JP | 11032971 | A | 2/1999 |
| JP | 04535746 | B2 | 9/2010 |
| JP | 2016165527 | A | 9/2016 |
| WO | 2001004261 | A1 | 1/2001 |
| WO | 2002049497 | A2 | 6/2002 |
| WO | 2002079370 | A1 | 10/2002 |
| WO | 2009047820 | A1 | 4/2009 |
| WO | 2016037446 | A1 | 3/2016 |
| WO | 2016041371 | A1 | 3/2016 |

OTHER PUBLICATIONS

International Search Report/Written Opinion dated Sep. 17, 2018.

* cited by examiner $$Na_2CO_3 \cdot 1.5H_2O_2 \xrightarrow[\text{water}]{} Na_2CO_3 + 1.5H_2O_2$$
FIG.14
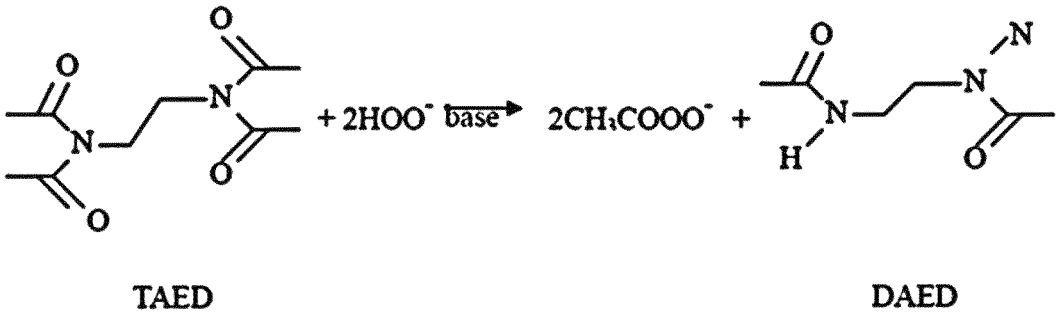
FIG.15
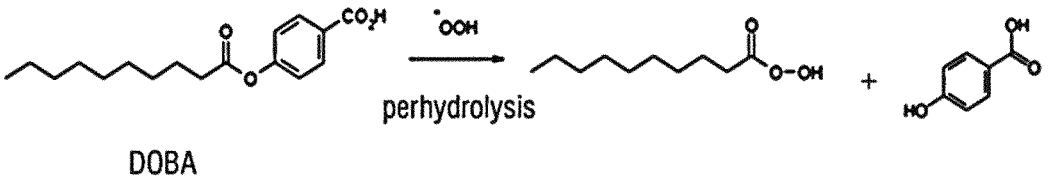
FIG.16

PORTABLE STAIN REMOVAL DEVICE

This application is the U.S. National Phase application under 35 U.S.C. § 371 of International Application No. PCT/EP2017/077907, filed on Oct. 31, 2017, which claims the benefit of International Application No. 16196680.9, filed on Nov. 1, 2016 and International Application No. 17185128.0, filed Aug. 7, 2017. These applications are hereby incorporated by reference herein.

FIELD OF THE INVENTION

This invention relates to the technical field of stain removal, and in particular it relates to a portable device for conveniently treating a stain on a fabric.

BACKGROUND OF THE INVENTION

Fabrics are common materials that can be used in such as garments and furnishing. They are typically able to absorb a fluid. This unique property means that they can be easily contaminated by contaminants such as food, drinks and writing markers, typically resulting in undesired spots on the fabric that cannot be easily removed without washing the fabric. These spots, which are often referred to as stains, may be removed through different burdensome processes.

In some occurrences, the stains may even require extensive local pre-treatment process prior to the laundry process. These are troublesome processes that can only take place when the whole fabric is due for washing.

The stain treatment process to be applied to a stain may depend on the classification of the stain. For instance, some stains are enzymatic stains which require the application of enzymes in removal. There are also some stains that can be oxidized and can be removed with an oxidizing agent.

The stains could be physically or chemically bonded to the fabrics. Again, the bonding types may affect the selection of stain removal process. Regardless of the stain types or stain bonding characteristics, most of the stain treatment processes may involve the application of a chemical reagent to the stains. The chemical reagent acts upon the stains directly.

Following the stain treatment process, the chemical reagent is usually removed to prevent undesired post-treatment effects, such as the possibility of skin irritation, allergic reactions, fabric bleaching, fabric oxidation or undesired chemical odor. In the existing step of removing the chemical reagent, it is likely that the whole fabric will be washed in a laundry machine, even if the chemical reagent was only applied to a small area of the fabric. The washing of the whole fabric is potentially time consuming and unnecessary, especially if the objective of the wash was just to remove the chemical reagent.

Specifically, at current, stain remover devices/solutions available on the market employ the following principles:

1. Mechanical means, such as ultrasonic pulsing or mechanical rubbing.
2. Chemical means, such as stain dissolving solutions, oxidation chemicals or detergents.
3. A combination of mechanical and chemical means.

These products often require 5 to 10 minutes of operation or waiting time before satisfactory effects can be obtained. In some instances, these products are unable to remove the stains effectively and efficiently.

The usage of an appropriate chemical can enhance the stain removing capability. Pad steam bleaching with hydrogen peroxide, or hydrogen peroxide with Peroxy acid is a method used in textile batch bleaching processes. This textile treatment processes decolorize the natural coloring matter present in the cloth. The process time required for high temperature hydrogen peroxide bleaching process ranges from 5 minutes to few hours. The high temperature is required because hydrogen peroxide bleaching produces good results at temperatures above 80° C.

To reduce energy consumption of the bleaching process, bleach activators and catalysts were developed to reduce the process temperature. Bleach activators and catalysts are compounds that react with hydrogen peroxide in aqueous solution to form peroxy acids. Unlike the pure hydrogen peroxide bleaching process, the peroxy acids are able to produce good results even at temperatures below 60° C. Therefore, bleach activators are common components of most laundry detergents.

Based on the above-mentioned investigation and analysis, the existing stain removing devices commonly require long application and waiting time. Moreover, the stain spots are not always easily or fully removed, leaving unsightly marks. These are known disadvantages of existing stain removing devices.

SUMMARY OF THE INVENTION

It is an object of the present invention to provide an improved portable device for removing stains on fabrics that avoids or mitigates above-mentioned problems.

Preferred embodiments of the invention are defined in the dependent claims.

The present invention is based on providing a stain removing device (the "device") implementing the functions of stain removing, and/or rinsing and/or drying.

The combination of those functions allows an effective stain treatment, without the need for washing the whole piece of fabric.

The removal of stain spots immediately upon staining is usually preferred. Local removal of stains without the need of washing the whole garment is highly desired. This may keep the fabrics look clean even if the next laundry cycle is not immediate. Therefore, a small and portable device, which is able to locally remove the stains in a quick manner, brings lot of benefits.

An advantage of a device providing localized stain removing, rinsing and drying for fabric treatment is that it is compatible with most of the commercially available garment treatment/stain treatment chemical reagents. Using the stain removing, drying and/or rinsing device, washing and removal of the chemical reagent is limited to only the local area that needs to be washed.

In a first aspect of the present invention, a portable stain removal device according to the invention for locally removing a stain on a fabric comprises:

- a chemical container for containing a chemical reagent,
- a dispensing mechanism for dispensing the chemical reagent out of the chemical container onto the fabric, and
- a heater for heating the fabric and/or the chemical reagent.

This combination of applying chemical reagent and heat allows accelerating the chemical reaction for stain removal. In other words, the stain is removed faster.

The portable stain removal device according to the invention allows a convenient removal of stains on a fabric, and allows the fabric continue to be in service immediately after the stain treatment. The fact that the device is portable, for example hand-held, makes it use easy by a user.

Preferably, the heater is chosen among the set defined by a heating plate, a hot liquid heater, a steam heater, an infrared radiation heater, a microwave heater, a hot air heater, and an exothermic reaction heater.

The heater may apply heat to the stained area of the fabric during the process of stain removing to accelerate the speed of the chemical reaction and thus improve effect of stain removing (i.e. combines heat with said chemical reagent to jointly remove said stains on said fabrics). Heat may be provided by a heat generating component that transmits heat to the fabric, stain, reagent applicator and/or reagent. Depending on whether the heat shall be applied to the fabric by means of hot steam, hot liquid, radiation and/or hot air different kind of heaters have to be used.

Preferably, the stain removal device further comprises a liquid tank for containing water and/or a chemical neutralizer. The liquid tank is configured to dispense water and/or chemical neutralizer into the chemical container and/or onto the fabric.

The liquid tank is configured to dispense water into the chemical container to dissolve the solid stain removal material placed (manually by user) in the chemical container.

The rinsing allows removing the excessive chemical residue after the stain removal process is completed. This is to prevent undesired chemical reaction. Examples of these undesired chemical reactions include color fading, oxidation of fabric, releasing of chemical odor and potential skin allergy of the user.

This combination of stain treatment and rinsing allows not only stain removal, but also removing the excessive chemical residue after the stain removal process is completed. This is to prevent undesired chemical reaction.

Preferably, the heater is configured to:

- heat the liquid tank for generating hot water and/or hot chemical neutralizer and/or steam, and/or
- heat the chemical reagent in the chemical container.

Heating the liquid tank allows generating hot water for better dissolving a solid stain removal material put into the chemical container and used to create the chemical reagent, and for increasing the concentration of the chemical reagent. Moreover, treating the stain with a heated chemical reagent will also improve the chemical reaction for stain removal.

Heating the liquid tank allows generating hot water and/or hot chemical neutralizer to be applied on the already treated stained, to increase the rinsing effect.

Heating the liquid tank allows generating hot water and/or steam for dissolving a solid stain removal material placed into the chemical container, for forming the chemical reagent under a liquid form.

Heating the chemical container allows a better dissolving of the solid stain removal material used to create the chemical reagent, and also allows increasing the concentration of the chemical reagent. Treating the stain with a heated chemical reagent will also improve the chemical reaction for stain removal.

The application of heat and the application of chemical reagent to the fabric can be performed simultaneously. Alternatively, the chemical reagent can be applied on the fabric before or after heat is applied to the fabrics. The heat provides the benefit of increasing the chemical reaction rate for stain removal. Moreover, heat also prevents premature saturation of the chemical reagent which would reduce the concentration and effectiveness of the reagent. In this invention, heat can be applied to both the chemical reagent and the fabric and stained area for optimal stain removing performance. However, the present invention can also function if heat is only and solely applied to either the fabric or the reagent.

In a second aspect of the invention, the portable stain removal device comprises:

- a detachable stain removal accessory containing a stain removing material,
- a liquid tank for containing a liquid,
- means for generating steam and/or cold liquid and/or hot liquid from said liquid,
- means for carrying said steam and/or cold liquid and/or hot liquid to the stain removal accessory for generating a chemical reagent intended to be applied onto the fabric.

In this embodiment, the stain removal accessory is mounted on the device by user, which brings more flexibility and convenience for user.

Preferably, the device comprises an insert slot for receiving the stain removal accessory.

This solution allows an easy mounting of the stain removal accessory on the device.

Preferably, the chemical container is vented.

A ventilation of the chemical container prevents excessive gas build-up during dissolving a chemical solid with water.

In a third aspect of the present invention, the portable stain removal device comprises:

- a liquid tank for containing water and/or a chemical neutralizer,
- a dispensing mechanism for applying water and/or chemical neutralizer out of the liquid tank onto the fabric to rinse the fabric, and
- a heater for heating the fabric and/or water and/or chemical neutralizer.

This combination of rinsing and drying allows not only removing the excessive chemical residue after the stain removal process is completed, but also evaporating the wet of the treated stained area so that the fabric can continue to be in service immediately after the stain treatment.

Heating water for rinsing will improve the rinsing effect. Heating the chemical neutralizer for rinsing will improve the rinsing effect. It is preferred to use either water or chemical neutralizer, but not necessarily both in a given rinsing step.

BRIEF DESCRIPTION OF THE DRAWINGS

These and other aspects of the invention will be apparent from and elucidated with reference to the embodiment(s) described hereinafter. In the following drawings

FIG. 14 shows the chemical formation of $H_2O_2$ from sodium percarbonate, FIG. 15 shows the chemical formation of peroxy acid from TAED, FIG. 16 shows the chemical formation of peroxy acid from DOBA.

DETAILED DESCRIPTION OF THE EMBODIMENTS

In the following description, it is noted that the terms chemical reagent and stain removing material can be used indifferently.

The invention relates to a portable stain removal device (the "device") implementing any combination of the following functions:

1) stain removing using a chemical reagent, 2) rinsing the stain residues and chemical residues, 3) evaporating water from the treated area of the garment.

Figure 10:
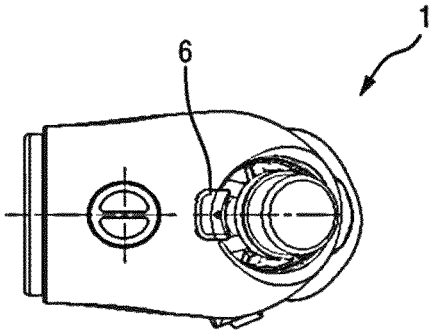
FIG. 8, FIG. 9 and FIG. 10 are respectively a back view, a side view and a top view of a portable device for removing the stains on the fabrics according to an embodiment of the present invention.
Figure 8:
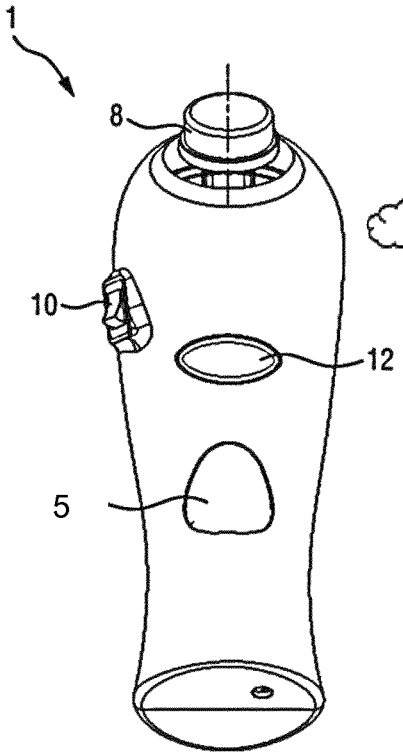
Figure 9:
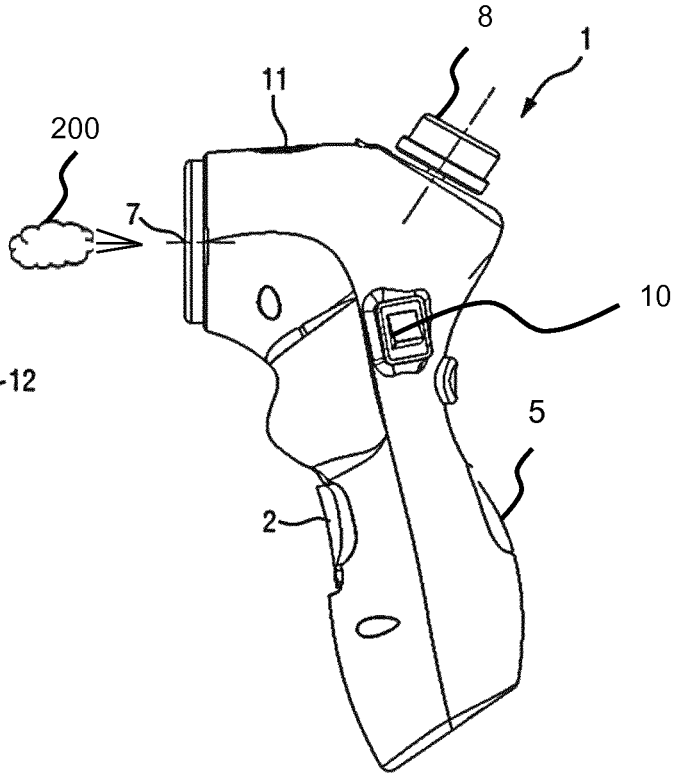

FIG. 8, FIG. 9 and FIG. 10 are respectively a back (or front) view, a side view and a top view of an example of a portable device 1 for treating a stain on a fabric according to an embodiment of the present invention.

FIGS. 12A to 12D are illustrations of a portable device 1 according the present invention during various steps of stain treatment of a stained area 101 of a fabric 100.

Figure 11:
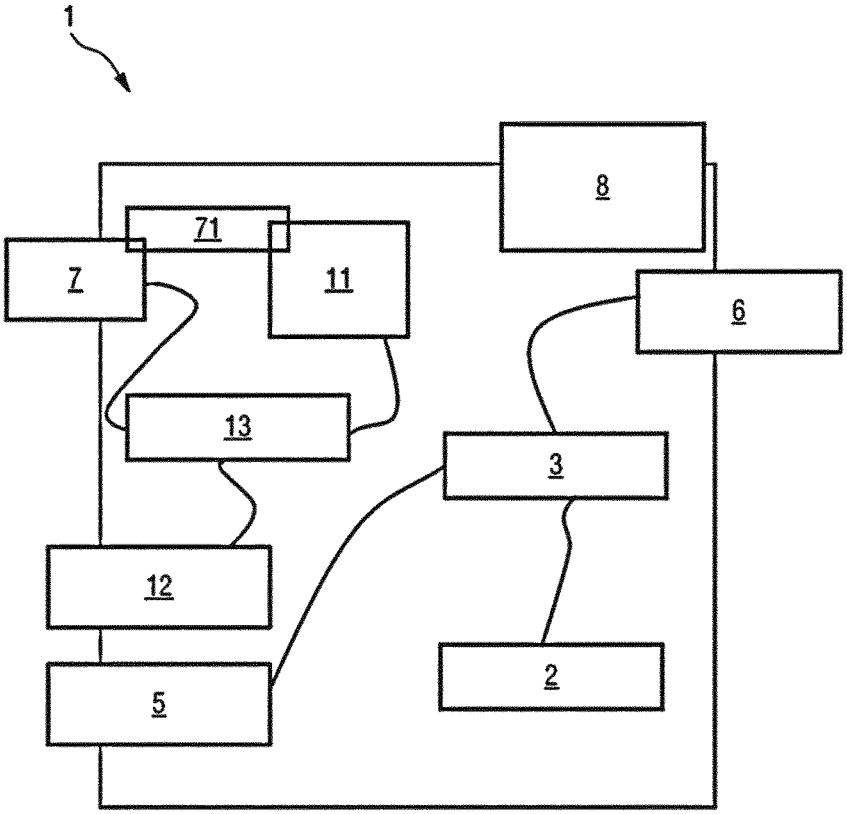
FIG. 11 is simplified module diagram of a portable device for removing the stains on the fabrics according to an embodiment of the present invention.

FIG. 11 is a simplified functional diagram of a portable device 1 for removing stain on a fabric 100 according to an embodiment of the present invention, such as the device 1 illustrated in the example of FIG. 8, FIG. 9 and FIG. 10.

In a first aspect of the invention, the portable stain removal device 1 comprises:

- a chemical container 11 for containing a chemical reagent,
- a dispensing mechanism 13 for applying the chemical reagent out of the chemical container 11 onto the fabric 100, and
- a heater 71 for heating the fabric 100 and/or the chemical reagent.

It is noted that the chemical container 11 can also be referred to as a "chemical tank".

Figure 19:
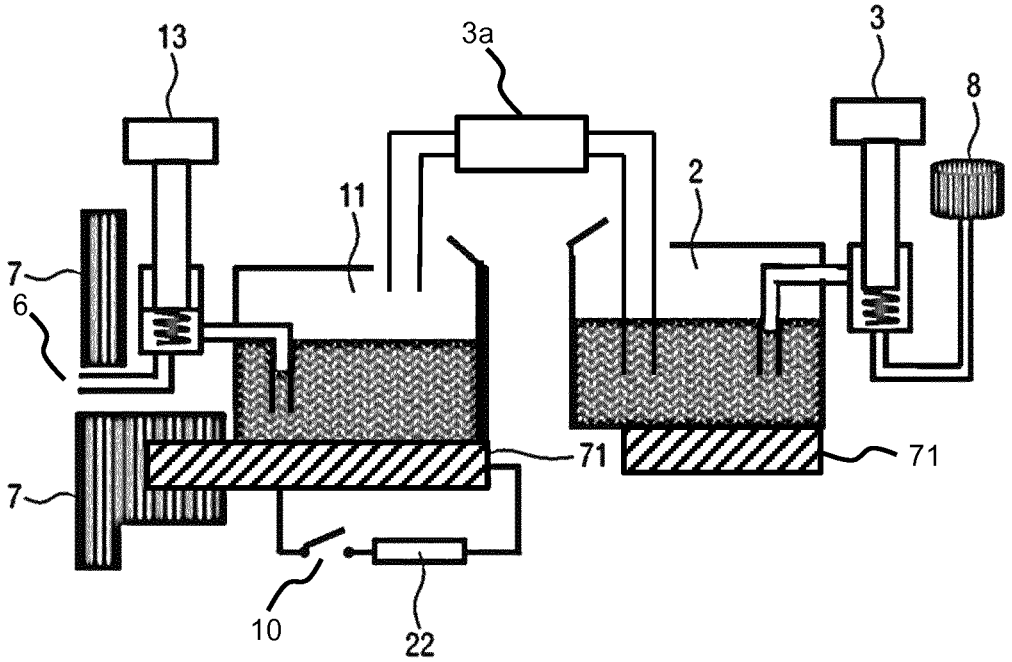
FIG. 19 is a first example of a detailed implementation of a device according to an embodiment of the present invention.
Figure 20:
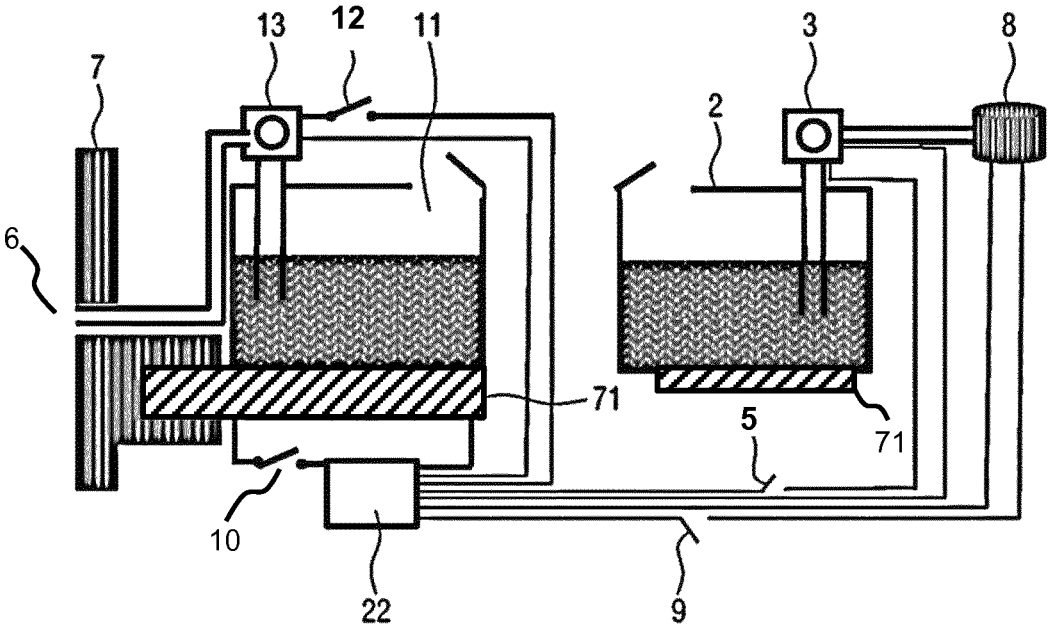
FIG. 20 is a second example of a detailed implementation of a device according to an embodiment of the present invention.
Figure 21:
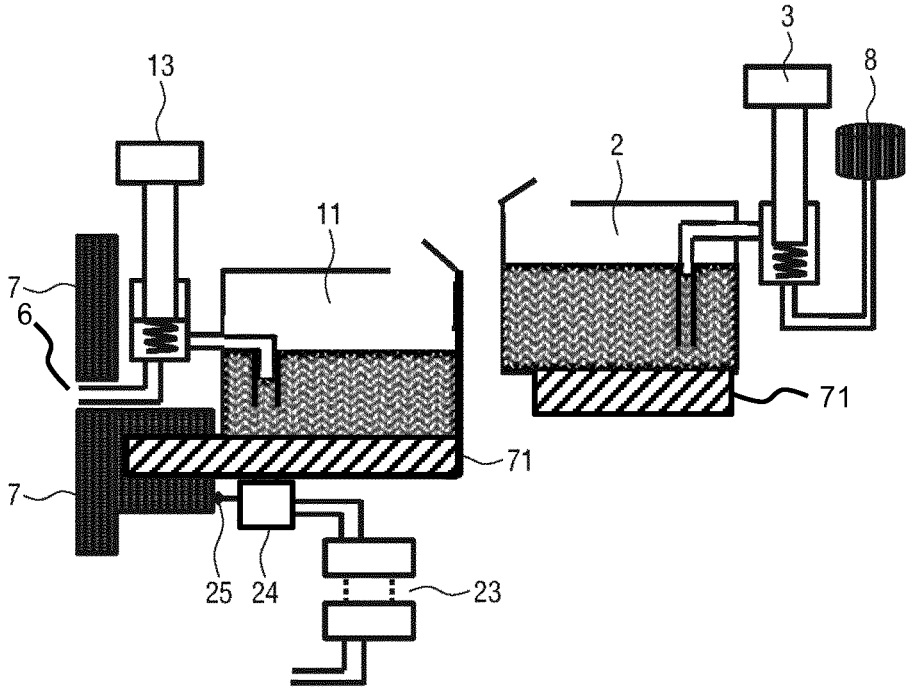
FIG. 21 is a third example of a detailed implementation of a device according to an embodiment of the present invention.

Examples of some corresponding implementations are illustrated in FIG. 19, FIG. 20, FIG. 21.

For example, the heater 71 is chosen among the set defined by a heating plate, a hot liquid heater, a steam heater, an infrared radiation heater, a microwave heater, a hot air heater, and an exothermic reaction heater.

Optionally, the device 1 comprises a liquid tank 2 for containing water and/or a chemical neutralizer. The liquid tank 2 is configured to dispense water and/or chemical neutralizer into the chemical container 11 and/or onto the fabric 100.

Preferably, the heater 71 is configured to:

- heat the liquid tank 2 for generating hot water and/or hot chemical neutralizer and/or steam, and/or
- heat the chemical reagent in the chemical container 11.

The heater 71 can be arranged adjacent to a heating plate 7 which is arranged at the front head of the device 1, as illustrated on FIG. 9, FIG. 19, FIG. 20, FIG. 21. The heater 71 can thus communicate thermal energy to the heating plate 7, for example by conduction. If the heating plate 7 is put in contact with the fabric, the fabric can thus be heated.

The heater 71 can also be arranged adjacent to the chemical container 11. The heater 71 can thus communicate thermal energy to the chemical container 11, for example by conduction. The chemical reagent being inside the chemical container 11 can thus be heated. The heated chemical reagent can thus be applied on the fabric 100, for example via an opening 6 arranged in the heating plate 7.

The chemical container 11 is intended to contain a chemical reagent under a liquid form. The chemical reagent can be directly filled-in (by user) in the chemical container 11. Alternatively, the chemical reagent is obtained by dissolving a stain removing material under a solid form, with water, inside the chemical container 11.

The stain removing material under solid form may take the form of powder or granule.

The chemical container 11 is preferably vented to prevent excessive gas build-up during the preparation of the chemical reagent by dissolving the stain removing material.

For example, the dispensing mechanism 13 is chosen among the set defined by mechanically actuated chemical dosing pump, an electrically actuated chemical dosing pump, a pressure based nozzle, a velocity based nozzle, a spray, and a dripping by gravity or any exerted force.

FIG. 19 and FIG. 21 show a dispensing mechanism 13 corresponding to a mechanically actuated chemical dosing pump, activated manually by user.

FIG. 20 shows a dispensing mechanism 13 corresponding to an electrically actuated chemical dosing pump activated electrically by user via the chemical dosing trigger 12.

When the liquid tank 2 is implemented and contains water, during the step of stain removing, water inside the liquid tank 2 can be carried to the chemical container 11, for example via a (electric) liquid pump 3*a* as illustrated in FIG. 19, establishing a fluid flow path between the liquid tank 2 and the chemical container 11. Water carried from the water tank 2 is used in order to dissolve a stain removing material under a solid form being into the chemical container 11.

The heating of the liquid tank 2 can be performed by the heater 71, for example by arranging a second portion of the heater 71 being in contact with a below part of the liquid tank 2.

If the heater 71 provides sufficient thermal energy to the liquid tank 2, water into the liquid tank 2 can be evaporated into steam, and the generated steam can be carried to the chemical container 11. The generated steam can thus be used to dissolve a stain removing material initially under a solid form into a liquid form 11. The steam can be carried directly by a fluid path, for example a simple tube (not shown) arranged between the liquid tank 2 and the chemical container 11.

Preferably, the chemical container 11 is vented. The vent can for example be arranged as a small opening (not shown) in an upper part of that chemical container 11.

In a second aspect of the invention, the portable stain removal device 1 is adapted to cooperate with a detachable stain removal accessory containing a stain removing material 300.

Figure 17A:
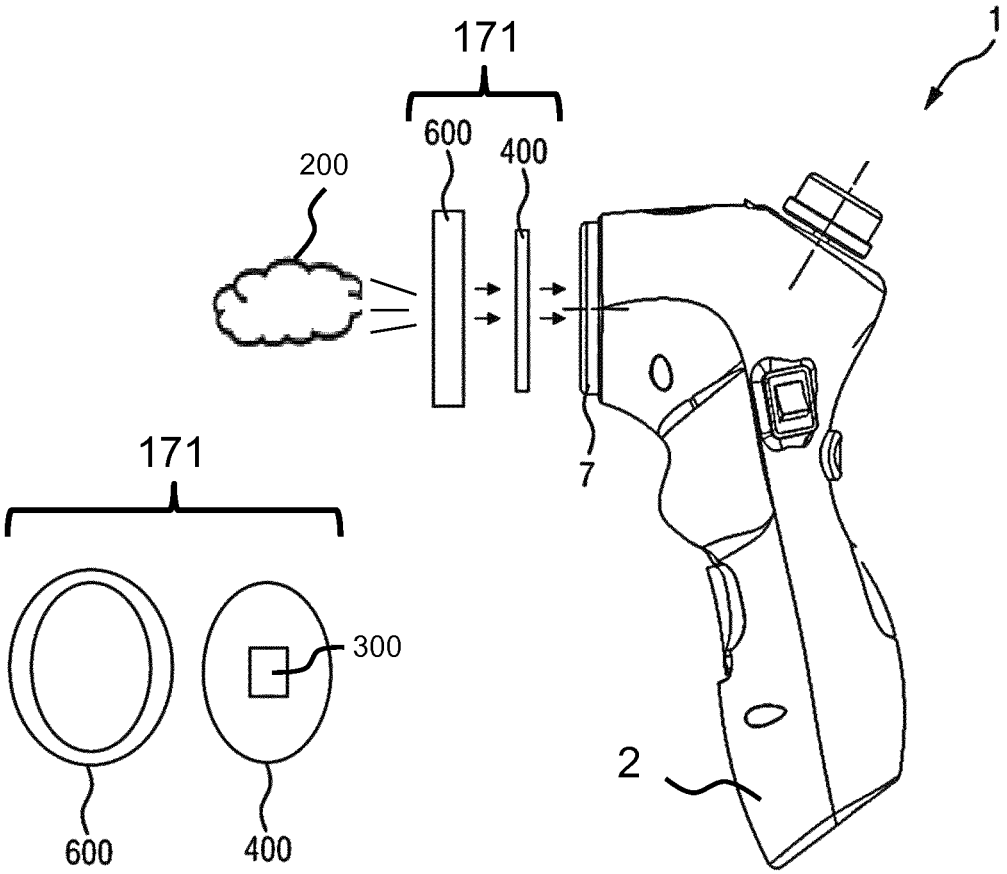
FIG. 17A is a schematic side view of the stain removal device cooperating with a stain removal accessory according to the invention, FIG. 17B are internal schematic views of the stain removal device and the stain removal accessory according to the invention.

An example of such a portable stain removal device is for example illustrated by the portable stain removal device 1 in FIG. 17A, when cooperating with a stain removal accessory 171.

To this end, the portable stain removal device 1 comprises:

- a detachable stain removal accessory 171 containing a stain removing material 300,
- a liquid tank 2 for containing a liquid,
- means for generating steam and/or cold liquid and/or hot liquid from said liquid,
- means for carrying said steam and/or cold liquid and/or hot liquid to the stain removal accessory 171 for generating a chemical reagent intended to be applied onto the fabric 100.

The liquid in the liquid tank 2 is preferably water.

Figure 22:
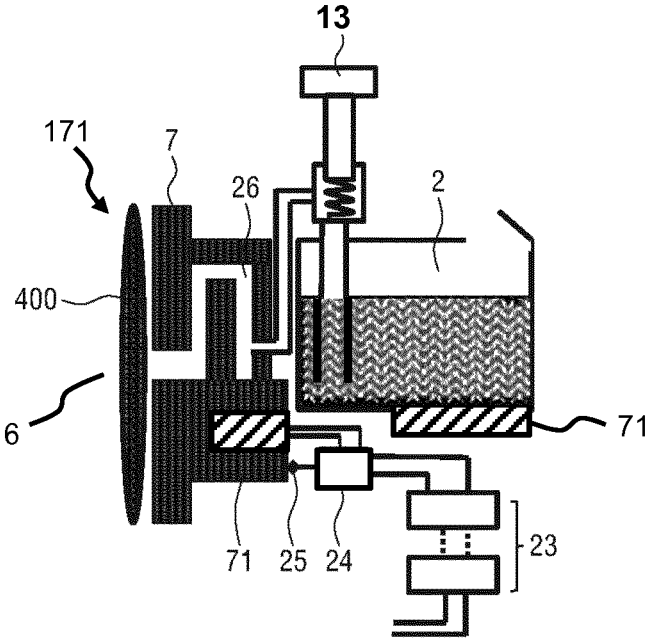
FIG. 22 is a fourth example of a detailed implementation of a device according to an embodiment of the present invention.

An example of a corresponding implementation is illustrated in FIG. 22.

In this implementation of FIG. 22, compared to embodiments of FIG. 19, FIG. 20, FIG. 21, only a liquid tank 2 is implemented. For example, the liquid tank 2 is arranged at the front head of the device 1.

Means for generating steam and/or hot liquid for example correspond to a steam chamber 26 arranged in the front head of the device 1. The steam chamber 26 is heated by a heater, such as heater 71. The steam chamber 26 is intended to evaporate the liquid carried from the liquid tank 2. To this end, the heater 71 is arranged adjacent to the steam chamber 26. A heating plate 7 is arranged at the front head of the device 1. The heating plate 7 may correspond to the external face of the steam chamber 26.

If the heater 71 is not switched-on, the steam chamber 26 is equivalent to a fluid path that does not substantially affect the temperature of the liquid. In this case, the liquid exiting the steam chamber 26 is a cold liquid (or room-temperature). Alternatively, cold water can be generated by connecting an additional fluid path (not shown) directly on the fluid tank 2.

If the heater 71 is switched-on, and supplied with energy not sufficient to evaporate the liquid from the liquid tank 2, the steam chamber 26 is equivalent to a heater that elevates the temperature of the liquid. In this case, the liquid exiting the steam chamber 26 is a hot liquid. Alternatively, hot liquid can be generated by arranging a portion of the heater 71 adjacent to the liquid tank 2.

If the heater 71 is switched-on, and supplied with energy sufficient to evaporate the liquid from the liquid tank 2, steam exits the steam chamber 26.

The steam and/or the cold liquid and/or the hot liquid may exit the steam chamber 26 at the opening 6 facing the stain removal accessory 171.

Means for carrying the steam and/or the cold liquid and/or the hot liquid correspond to:

- a dispensing mechanism 13 similar as the one described above,
- the fluid path formed inside the steam chamber 26.

Preferably, the stain removal device 1 comprises means for heating the fabric 100 and/or the stain removal accessory 171.

The heater 71 may for example be used to this end.

The heater 71 can be arranged adjacent to the heating plate 7. The heater 71 can thus communicate thermal energy to the heating plate 7, for example by conduction. If the heating plate 7 is put in contact with the fabric, the fabric can thus be heated.

If the stain removal accessory 171 is mounted adjacent or next to the heating plate 7, the stain removal accessory 171 can also be heated, for example by conduction. Heating the stain removal accessory 171 indirectly helps to heat the generated chemical reagent for a more efficiency chemical reaction for stain removing.

In the embodiments of FIG. 19 and FIG. 20, various elements are supplied in electrical energy by the power supply 22.

Regarding the embodiment of FIG. 22, the opening 6 on the heating plate 7 is sized to enable the outgoing steam 200 to have a certain velocity. This velocity is a function of the size of the opening and the steam rate. For a steam rate of 25 g/min, the optimal opening dimension is 6 mm in diameter. This combination gives a good steam rate and velocity to enhance the rinsing because the velocity creates a pressure difference between the treatment side and underside of the fabric 100. The pressure difference pushes the fluid 200 through the fabric 100. The relatively low steam rate also enables longer operation without the need for a large liquid tank 2.

Optionally, the steam rate can be between 5 g/min and 150 g/min. The diameter of the opening 6 can be between 3 mm and 30 mm. The steam 200 can be pure dry steam 200 (commonly transparent and hard to be envisaged by naked eyes) or wet steam 200 (commonly white color). It was observed that wet steam 200 (steam with droplets of water) produced better rinsing results but wetter fabric 100.

Rinsing duration is dependent on the required quality of rinse. It was observed that rinsing duration should be at least 10 seconds with this defined opening size and steam rate. The rinse duration should be at least 3 seconds for such a device 1 of the present invention.

Optionally, after the rinsing process, the heating plate 7 may also be used for drying. During drying, the heating plate 7 should have a temperature between 60° C. and 170° C.

In the embodiment of FIG. 22, various elements are supplied in electrical energy by a cordless power supply 23 comprising a base cooperating with a detachable energy accumulator (for example a rechargeable battery). The process of supplying electricity to the heater 71 is controlled by a control unit 24. In particular, the control unit 24 receives information from the temperature sensor 25 to control the heater 71.

Preferably, the device 1 comprises an insert slot 18 for receiving the stain removal accessory 171. The insert slot 18 is further described along with FIG. 13 and FIG. 18B.

In a third aspect of the invention, the portable stain removal device 1 comprises:

- a liquid tank (2) for containing water and/or a chemical neutralizer,
- a dispensing mechanism (3) for applying water and/or chemical neutralizer out of the liquid tank (2) onto the fabric (100) to rinse the fabric (100), and
- a heater (71) for heating the fabric (100) and/or water and/or chemical neutralizer.

Examples of some corresponding implementations are illustrated in FIG. 19, FIG. 20, FIG. 21, as already presented above.

For example, the dispensing mechanism 3 is chosen among the set defined by mechanically actuated chemical dosing pump, an electrically actuated chemical dosing pump, a pressure based nozzle, a velocity based nozzle, a spray, and a dripping by gravity or any exerted force.

In the embodiment of FIG. 19 although the dispensing mechanism 3, 3*a*, 13 have been described as separate elements, they could actually be combined into a single dispensing mechanism (not shown) connected to a valve selector (not shown) for defining various fluid paths to carry fluid from the chemical container 11 and the fluid tank 2.

During the step of rinsing, when water and/or chemical neutralizer is contained in the liquid tank 2, water and/or chemical neutralizer carried by the dispensing mechanism 3 is applied to the fabric 100 in order to rinse the stained area already treated/removed.

FIG. 19 and FIG. 21 show a dispensing mechanism 3 corresponding to a mechanically actuated chemical dosing pump, activated manually by user.

FIG. 20 shows a dispensing mechanism 3 corresponding to an electrically actuated chemical dosing pump activated electrically by user via the rinsing trigger 5.

The rinsing process allows rinsing the chemical reagent on the fabric and for removing the generated rinsing medium. The main objective of this rinsing process is to stop the chemical reaction upon the complete removal of the stain, so as to prevent further chemical reactions. Specifically, the rinsing process involves the sub-processes of diluting/neutralizing the chemical reagent and the removal of the diluting/neutralizing medium after the dilution/neutralization. For the best rinsing result, these chemical residues should be extracted from the fabric.

The first step of rinsing involves the addition of a fluid for dilution or neutralization of the chemical reagent. The fluid can be drawn from a reservoir and dosed onto the fabric through an opening on the device. The fluid may also take the form of a powder or solid. Fluid may also be applied through another carrier (not necessarily water), which could be another fluid, such as a chemical neutralizer, or another combination of fluids. The rinsing fluid dosing rate can be between 5 g/min and 150 g/min.

The fluid also has a second function of carrying the chemical reagent out of the fabric, i.e. the second step of rinsing.

According to the invention, the rinsing process works on two main principles: Dilution and Extraction. In dilution, fluid is flushed onto the fabric to dilute and flush out the chemical reagent. During the extraction process, fluid extraction, such as by using chemical neutralizer, may be applied to enhance the rinsing. With every cycle of dilution and extraction, the residual chemical concentration is reduced. Optionally, dilution may take place concurrently with extraction.

Multiple rounds of fluid addition and fluid removal can/may be conducted for more thorough rinsing.

Preferably, a brush 8 (optionally electro-mechanical motor brush) is arranged at the flow exit of the dispensing mechanism 3. The brush itself performs a mechanical action on the stained area. The brush 8 is for scrubbing the fabric, in particular by one or more of rotary motion, tapping motion, rubbing motion, and ultrasonic pulsing. The brush supports the mechanical removal of the stain spot, and provides a mechanical means and a pressure means of helping the rinse fluid pass through and out of the fabric. The brush 8 provides a mechanical means and a pressure means of helping the rinse fluid 200 pass through the fabric 100 and/or out of the fabric 100.

The brushing efficiency is improved by the flow of water and/or chemical neutralizer spread at proximity of the brush, or even inside the brush.

Drying of the post-rinsed fabric relies on removal of the wet/moisture in the fabric. In general, there are at least three possible means in wet/moisture removal. They are:

- an absorbent counterpart (backing pad) to extract fluid out of the fabric,
- heat to vaporize the fluid, and/or
- air flow over the fabric to carry the fluid vapor.

An example of direct heating for drying is with the heating plate 7, such that water is evaporated off, similar to drying with an electrical iron. To this end, the heating plate 7 is then directed to the stained fabric 100.

For other examples, the heat is produced by means of radiation and/or hot air to vaporize the wet on the fabric.

As for the heating plate 7, the plate should be between 60° C. to 170° C. A temperature of 150° C. gives the optimal balance between drying speed and reduced risk of scorching fabric. The moisture can also be removed effectively by moving heated air of at least 60° C.

The device according to the invention can utilize one or more of these three drying means (absorbent backing pad, heating and air flow) and still fit within a portable device.

As shown on FIG. 8 and FIG. 9, the device 1 comprises a temperature switch 10 that enables two temperature settings. This is optional but could be beneficial for treating different fabric types. For instance, delicate fabrics 100 require lower temperature for drying, while normal fabrics 100 can withstand higher temperatures for faster drying.

FIGS. 12A to 12D are illustrations of a portable device 1 according the present invention during various steps of stain treatment of a stained area 101 of a fabric 100.

Figure 12A:
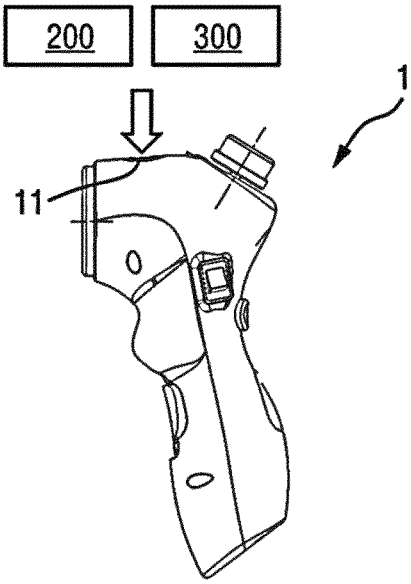
FIGS. 12A to 12D are illustrations of a portable device 1 according to the present invention during various steps of stain treatment.

FIG. 12A shows the beginning of the stain removal process, wherein the chemical container 11 of the device 1 is preferably first heated, such that the chemical container 11 reaches a temperature of at least 65° C. The optimal temperature is between 80-90° C., though a temperature range of 65° C. to 120° C. is acceptable. The stain removing material is added in the chemical container 11 and dissolved by water and/or steam to form an aqueous chemical reagent.

Alternatively, this chemical solution can be prepared outside of the device 1 and added to the device as an aqueous solution.

Figure 12B:
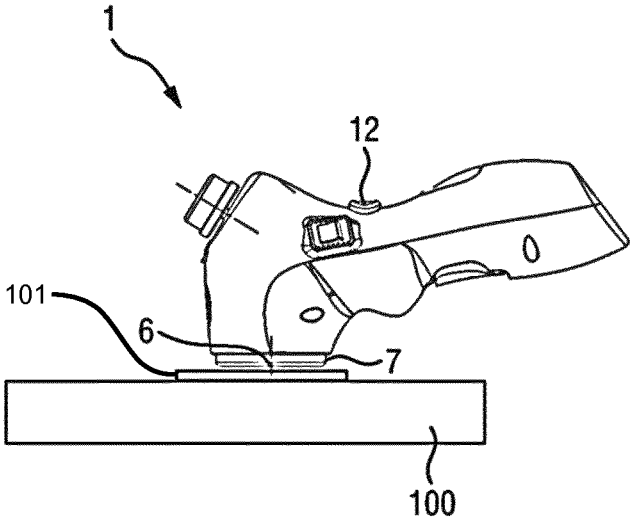

FIG. 12B shows the chemical treatment phase of the stain removal process. When the stain removing material has dissolved, it is applied onto the stained area 101 of the fabric 100 by activating the chemical dosing trigger 12. The chemical dosing trigger 12 activates the dispensing mechanism 13 to dispense the dissolved chemical through an outlet 6 on the heating plate 7. As the dissolved chemical is being dispensed, the heating plate 7 should be placed on the surface of the stained fabric 100 to enable heating of the wetted fabric 100.

The heat provided during the stain removing process is optional, but can greatly enhance stain removal result and speed by accelerating the chemical reaction.

Alternatively, heat can be applied through other forms of heating, such as hot air, steam, microwave and exothermic reaction.

Figure 12C:
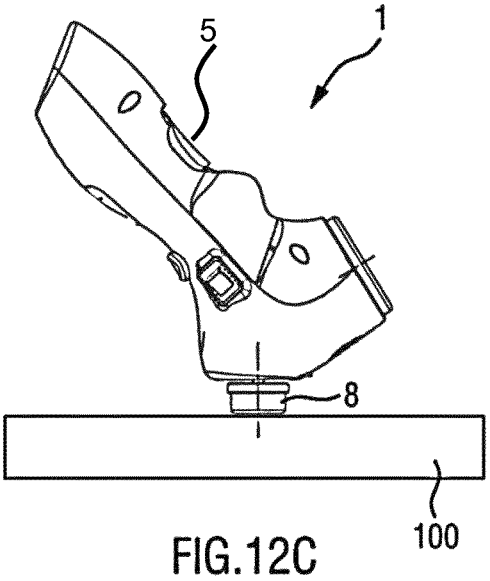

FIG. 12C shows the rinsing phase. Once the stain visibility has been reduced to a level that is acceptable by the user, the device 1 will enter the phase of rinsing.

In the rinsing phase, a brush head 8 of the device 1 is placed on the fabric 100 that is to be rinsed. The rinsing trigger 5 is then activated to activate the dispensing mechanism 3. Water is pumped from the liquid tank 2, through the dispensing mechanism 3 and out from an outlet next to the brush 8. This process dilutes the chemical residue and washes the fabric 100 using water or aqueous solution. At the same time, the motorised brush head 8 is activated to provide mechanical scrubbing action to push the waste water through and out of the fabric 100. Alternatively, the motorised brush 8 may be replaced by a sub-device that is able to provide mechanical action, such as a tapping motion, a forward-backward linear motion or a circular motion. Alternatively, a chemical neutraliser may be applied to neutralise the residual chemical.

Figure 12D:
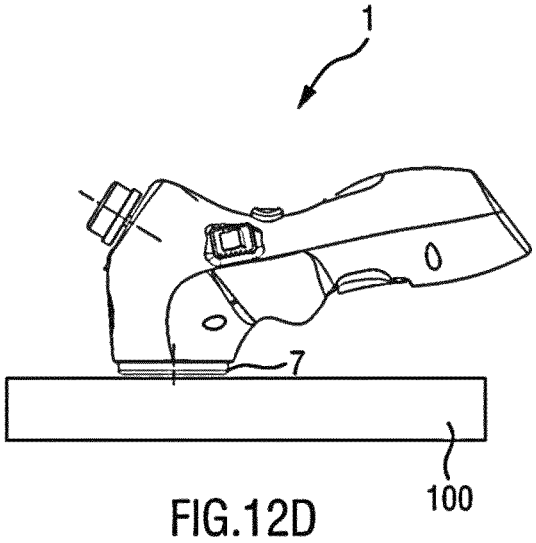

FIG. 12D shows the drying phase. When rinsing is completed, the user moves on to the third process, which is the drying process. This process is optional and is independent of the stain removal process as such. However, it brings extra convenience to the user, such that the treated fabric 100 can be used almost immediately without waiting for the fabric 100 to dry. The temperature switch 10 of the device 1 is first activated to raise the temperature of the heating plate 7 to approximately 150° C. Alternatively, a temperature range of 100° C. to 170° C. is suitable for drying. The heating plate 7, which will be used for drying, should preferably be cleaned prior to the drying process. The heating plate 7 is placed onto the rinsed fabric 100 to provide for localised drying, similar to the action of an electric iron. The process is completed upon drying of the fabric 100. Alternatively, drying may be achieved through other means of providing heat or air movement, such as hot air over 60° C. may also be used for drying, radiation, moving air or vacuum extraction.

FIG. 17A is a schematic side view of the stain removal device 1 cooperating with a stain removal accessory 171 according to the invention.

In the present context, it is noted that the stain removal accessory according to the invention can also be called a "chemical bleach applicator".

The stain removal accessory 171 comprises:

- a container 400 for containing a stain removing material 300.
- a holder 600 for holding the container 400.

It is noted that the holder 600 can also be called a "frame".

The stain removal accessory 171 is adapted to release the stain removing material 300 on the stained area when cooperating with the stain removal device.

Preferably, the container 400 is disposable.

The stain removing material 300 corresponds to bleach chemical. Most of stain removing material 300 (Sodium percarbonate, TAED, DOBA, NOBS, etc) used in a laundry cleaning or dish washer products are in solid form (e.g. powder, granule). The stain removing material 300 requires to be dissolved in fluid 200 generated by device 1 in order to release 11202 or peroxy acid. In particular, fluid 200 corresponds to water and/or steam. $H_2O_2$ or peroxy acid kills bacteria and removes stains on a material like fabric, glass, or plastic by oxidizing the stain molecules from colored structure to colorless structure.

FIG. 14 shows the chemical formation of $H_2O_2$ from sodium percarbonate.

FIG. 15 shows the chemical formation of peroxy acid from TAED.

FIG. 16 shows the chemical formation of peroxy acid from DOBA.

The stain removing material 300 may contain:

- Active oxygen sources, e.g. hydrogen peroxides ($H_2O_2$); Sodium percarbonate ($Na_2CO_3.1.5H_2O_2$); sodium perborate ($NaBO_3.H_2O$, or $NaBO_3.4H_2O$), etc. and
- Preferably also any one of the following bleach activator (taken alone or in combination):
  - tetraacetylethylenediamine (TAED),
  - 4-decanoyloxybenzoic acid (DOBA),
  - sodium salt of nonanoyloxybenzenesulphonic acid (NOBS),
  - sodium salt of 3,5,5-trimethylhexanoyloxyphenylsulfonic acid (iso-NOBS),
  - sodium salt of acetoxyphenylsulfonate,
  - sodium decanoyloxybenzene sulfonic acid (DOBS), sodium
  - octanoyloxybenzene sulfonic acid (OOBS),
  - GOBS,
  - sodium nonanoyloxybenzoic acid (NOBA),
  - N,N-Diacetylethylenediamine,
  - N-[4-(triethylammoniomethyl)benzoyl]butyrolactam-chloride (TBBC),
  - sodium trimethylhexanoyloxybenzenesulfonate (STHOBS),
  - sodium-4-benzoyloxybenzenesulfonate (SBOBS),
  - glucose pentaacetate (GPA),
  - tetraacetylglucoluril (TAGU),
  - nitrilotriacetate (NTA),
  - transition metal bleach catalyst etc.

The stain removing material 300 is a chemical reagent in solid form (powder, granule), or in liquid form (in this case the liquid is held in a wet bag or wet tissue).

Preferably, the container 400 takes any of the forms defined by a bag, a pad, a cartridge, a sachet, and a capsule. The container 400 may looks like a "tea bag" with fluid-permeable external layer, for example made of density paper, fabric, non-woven fabric, porous plastic, etc.

The stain removal accessory 171 is adapted to release the stain removing material 300 on the stained area 101 when cooperating with the stain removal device 1.

Preferably, as illustrated, the holder 600 comprises a frame structure arranged at least partly around the container 400. For example, the frame structure can be circular, elliptic, arc-shaped, triangular, rectangular, square, semi-circular or semi-elliptic.

The right-side view of FIG. 17A shows an exploded view of the mounting of the stain removal accessory 171 when cooperating with device 1.

The stain removal accessory 171 can be mounted onto the steam venting face (sometimes combined with the heating plate together) of the device 1. Device 1 may correspond to a steam generation device, for example a garment steamer.

Figure 17B:
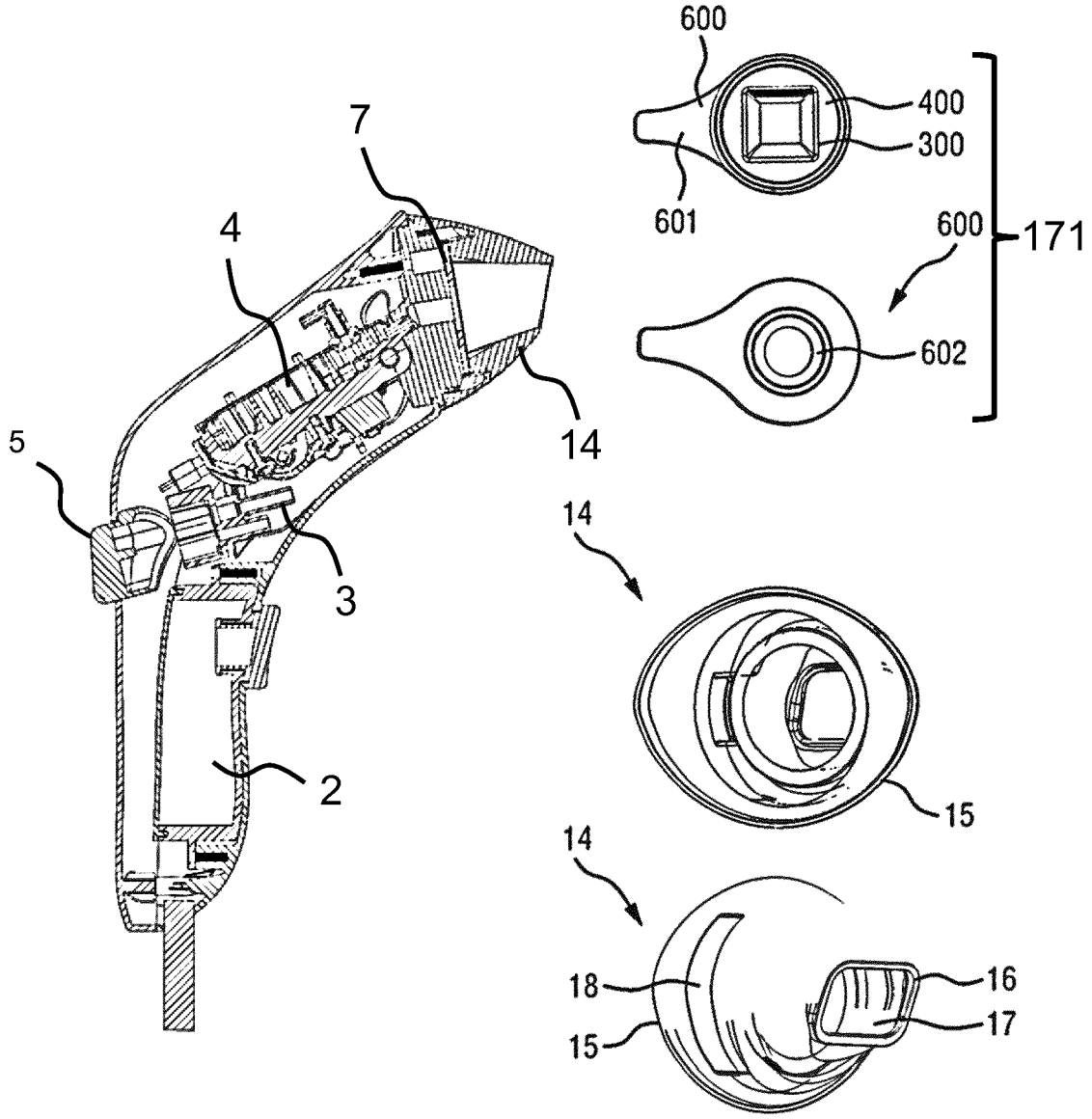

FIG. 17B are internal schematic views of the stain removal device 1 and the stain removal accessory 171 according to the invention.

Preferably, a guide head 14 is further assembled to the holder 600. Alternatively, the guide head 14 is assembled to the front side of the device 1, while the guide head 14 enclosing the stain removal accessory 171. The guide head 14 may comprise a back end interface 15 and a front end interface 16. The back end interface 15 receives the fluid 200 generated by the device 1. The front end interface 16 gathers the fluid 200 into a spout 17 facing the stained area on a fabric.

A liquid tank 2 supplies water to a dispensing mechanism 3, for example a pump. The dispensing mechanism 3 supplies water 200 to a steam engine 4. A pressing trigger 5 allows activating the dispensing mechanism 3. The steam engine 4 supplies steam 200 to the guide head 14. The heating plate 7 is in thermal connection the steam engine 4, so that the heating plate 7 can be heated.

In a first working mechanism, the fluid 200 generated by the device 1 is steam and passes through the container 400. The bleach solid 300 inside the container 400 is then dissolved by the steam condensation and carried out onto the stained area.

In a second working mechanism, the container 400 is used with (hot) water 200 generated by the stain remover device 1. To this end, water from the water tank 2 is carried by an additional pump (not shown) to the front head of the device 1. A heating element (not shown) is implemented if hot water is intended to be generated. The (hot) water/steam 200 passing through the container 400, and carries out the dissolved bleach solution 300 onto the stained area.

In a third working mechanism, if the stain removing material 300 is under liquid form in the container 400, there is no need for the device 1 to provide water and/or steam. The front head of the device 1 holding the stain removal accessory 171 is directly applied on the stained area.

Figure 13:
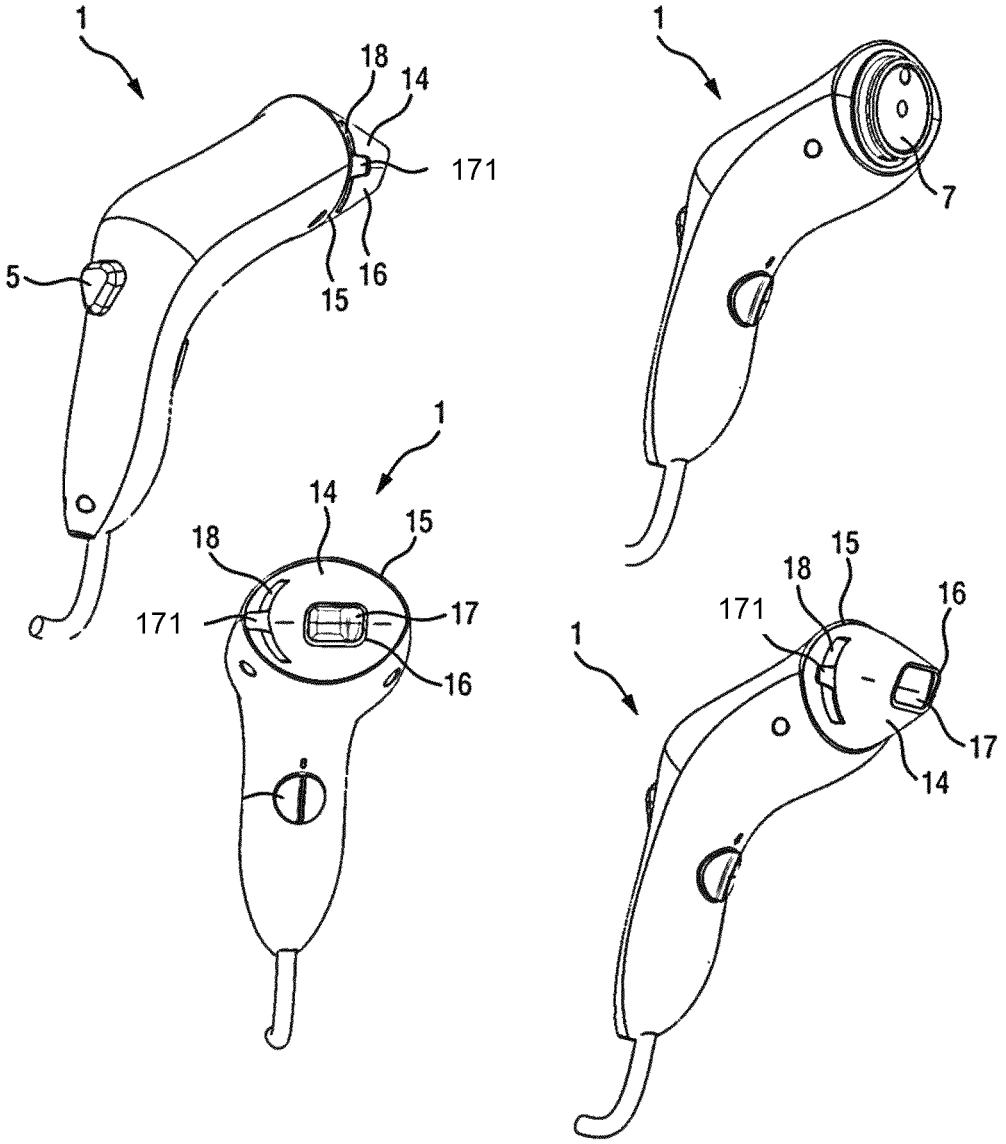
FIG. 13 are various schematic perspective views of a stain removal device according to an embodiment of the present invention.

FIG. 13 shows various schematic perspective views of a stain removal device 1 using a guide head 14 for treating the stain on a fabric according to the present invention.

The opening 6 on the heating plate 7 is sized to enable the outgoing steam 200 to have a certain velocity. This velocity is a function of the size of the opening and the steam rate. For a steam rate of 25 g/min, the optimal opening dimension is 6 mm in diameter. This combination gives a good steam rate and velocity to enhance the rinsing because the velocity creates a pressure difference between the treatment side and underside of the fabric 100. The pressure difference pushes the fluid 200 through the fabric 100. The relatively low steam rate also enables longer operation without the need for a large liquid tank.

Optionally, the steam rate can be between 5 g/min and 150 g/min. The diameter of the opening 6 can be between 3 mm and 30 mm. The steam 200 can be pure dry steam 200 (commonly transparent and hard to be envisaged by naked eyes) or wet steam 200 (commonly white color). It was observed that wet steam 200 (steam with droplets of water) produced better rinsing results but wetter fabric 100.

Preferably, the holder 600 of the stain removal container comprises a hand grip 601 (also called a holding tab) allowing to easily inserting the holder 600 of the stain removal accessory 171 into the insert slot 18 of the stain removal device 1.

Furthermore, the holder 600 of the stain removal container 400 may comprise a rear 602 to create a thermal contact with the heating plate 7 when the holder 600 is attached to the device 1.

FIGS. 18A to 18F is a set of schematic usage illustrations of the stain removal device 1 with a stain removal accessory 171 according to the invention.

Figure 18A:
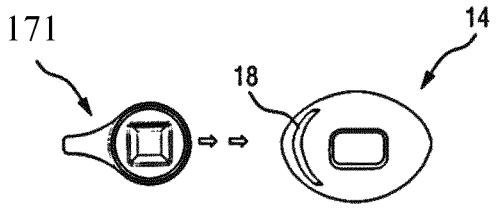
FIGS. 18A to 18F is a set of schematic usage illustrations of the stain removal device with a stain removal accessory according to the invention.
Figure 18B:
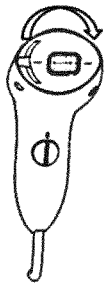

Device 1 comprises the guide head 14 attached to the steam venting face of the device 1, and with which the stain removal accessory 171 is intended to be cooperate, for example by inserting the stain removal accessory 171 in the slot 18 arranged in the guide head 14, as illustrated in FIG. 18A and FIG. 18B.

As most of bleach contents 300 (Sodium percarbonate, TAED, DOBA, NOBS, etc.) used in a laundry cleaning or dish washer product is in solid form (e.g. powder, granule), the bleach solid chemical contained in the container 400 requires to first be dissolved in water 200 in order to release $H_2O_2$ or peroxy acid. To this end, the stain removal accessory 171 is attached to the device 1 in order to release the dissolved bleach solution 300.

Figure 18C:
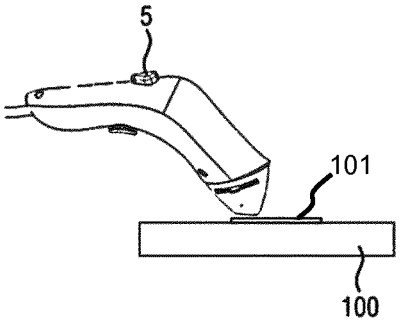

FIG. 18C shows the stain removing process.

The stain removing material 300 are cleaning agents that are pre-filled in the container 400. Once dissolved by water and/or steam, the stain removing material 300 are dispensed onto the stained area 101 of the fabric to react with, dissolve or cover the stain molecules. To this end, the front head of the device 1 can be brought into close contact with the stained area 101, as illustrated in FIG. 18C.

The device 1 may also provide heat to the stained area 101 in order to accelerate the chemical reaction, dissolving or covering rate. Heat sources include but are not limited to steam, conduction, infrared heat and microwaves. For example, a heating plate 7 can be used to generate heat by conduction.

In order to activate the stain treatment process, the rinsing pump is activated via the pressing trigger 5 (possibly repeatedly) so that water (and/or steam) can pass through the container 400.

Figure 18D:
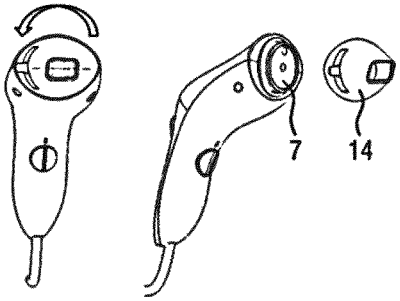
Figure 18E:
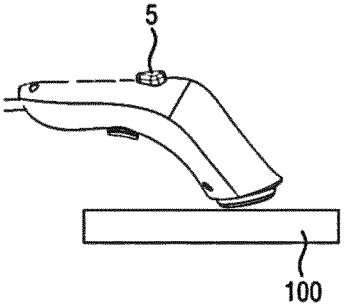

FIG. 18E shows the rinsing process. The main objectives of this stain rinsing process are:

1) to stop the chemical reaction upon after the step of stain removing, so as to prevent further chemical reactions.

2) to remove the stain removing material and their by-products from the garment 100 to avoid possible irritation/allergic reactions when the garment is put on by user.

It is noted that in order to guarantee that the fluid 200 used for rinsing (i.e. water, steam, chemical neutralizer or a combination of all) is not contaminated by the chemicals remaining in the container 400, the stain removal accessory 171 (or at least the container 400) needs to be removed from device 1 before starting the rinsing step.

FIG. 18D shows the detachment of the stain removal accessory 171 and guide head 14 from the device 1. The stain removal accessory 171 can for example be attached/detached via a rotating movement.

The rinse process can be achieved by either neutralization of the bleach chemical or dilution of the bleach chemical. For the best rinsing result, these chemical residues should preferably be extracted from the fabric by an absorption means (for example a backing pad, a tissue, a towel . . . ) or by mechanical forces. The rinsing process is activated by the pressing trigger 5 (possibly repeatedly).

Figure 18F:
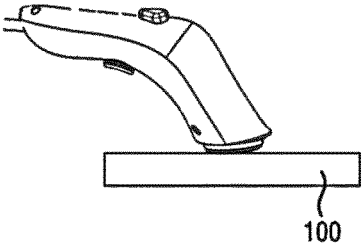

FIG. 18F shows the drying process.

Drying of the already rinsed fabric 100 relies on removal of the moisture on the fabric 100. The moisture can be evaporated through direct heating with the heating plate 7 (~100-170° C.) or heated air 7 (~60-100° C.).

Other embodiments of a stain removal device according to the invention are now described.

Figure 23:
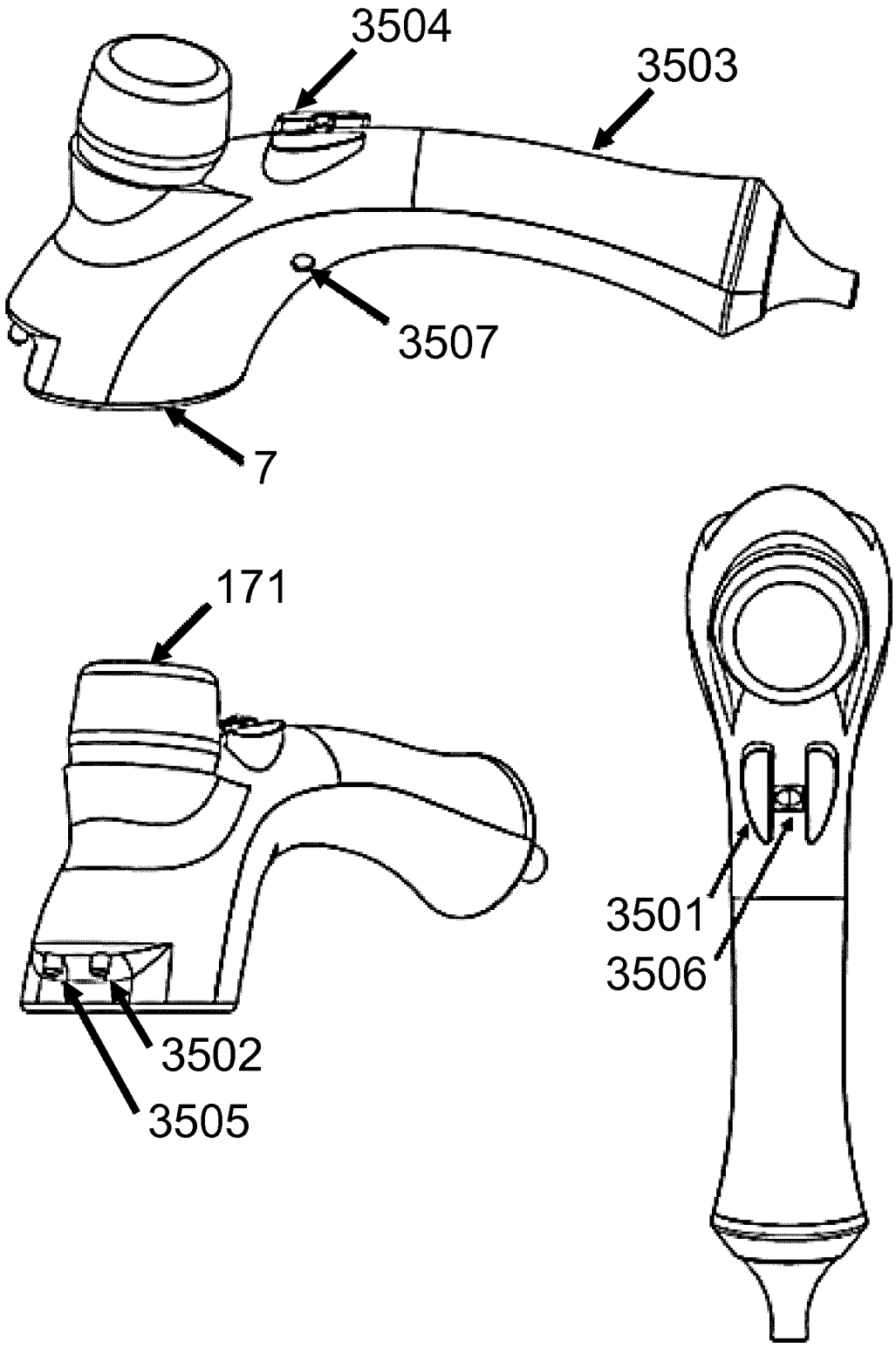
FIG. 23 depicts an example of a device according to the invention for a liquid-chemical cartridge.

FIG. 23 depicts an example of a device according to the invention for a detachable stain removal accessory 171 taking the form of a liquid-chemical cartridge.

The device comprises:

- a heating plate 7 adapted to diffuse heat (for example by an electrical heating element),
- a detachable liquid-chemical cartridge 171,
- a chemical-dosing trigger 3501,
- a chemical-dosing system (such as a pump, not shown) and the required tubes,
- a chemical-dosing nozzle 3502,
- a detachable and refillable water tank 3503 for holding rinsing water,
- a rinsing pump (not shown) to supply water,
- a rinsing-pump trigger 3504,
- a rinsing-water nozzle 3505,
- an optional brush (manual or electromechanical-motor brush), not shown,
- a temperature switch 3506, and
- a temperature-indicator light 3507.

Figure 24:
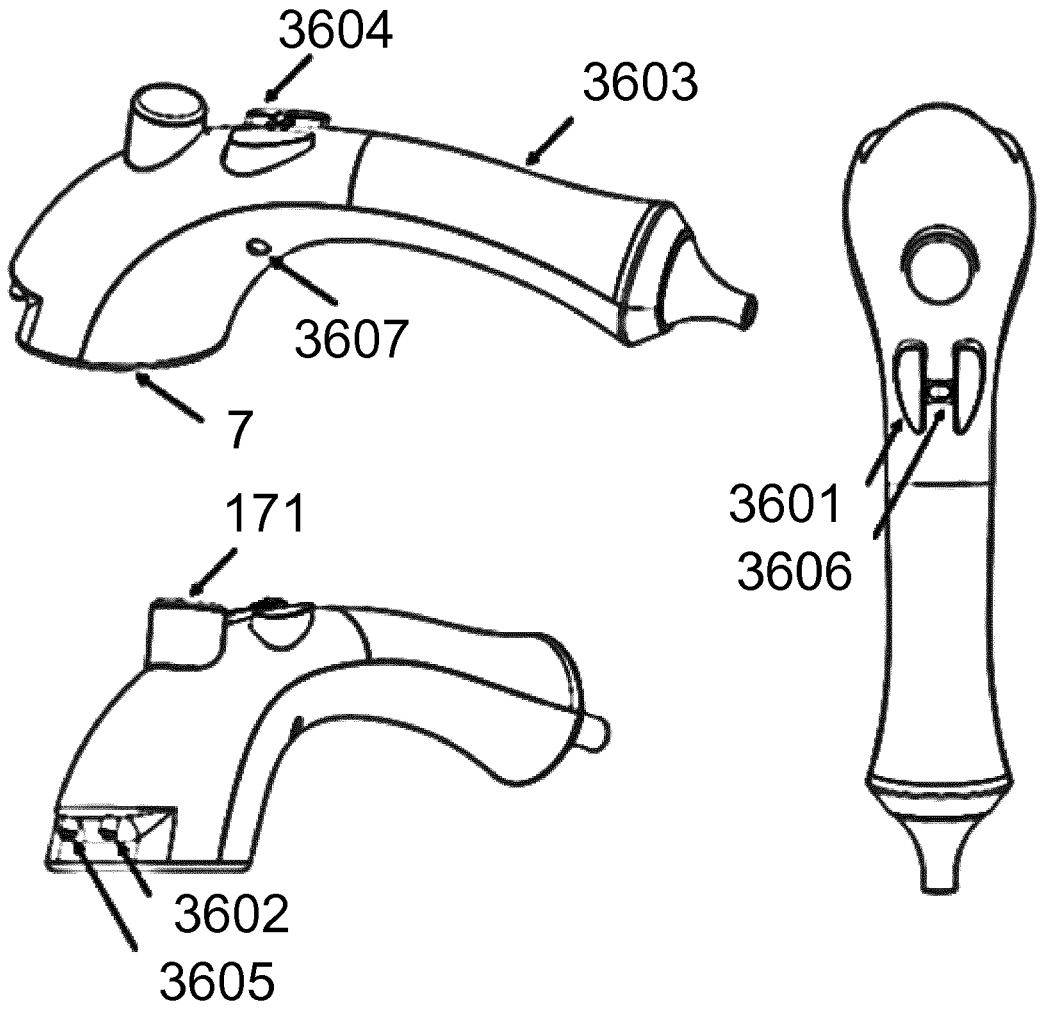
FIG. 24 depicts an example of a device according to the invention for a powder-chemical cartridge.

FIG. 24 depicts an example of a device according to the invention for a detachable stain removal accessory 171 taking the form of a powder-chemical cartridge.

The device comprises:

- a heating plate 7 adapted to diffuse heat (for example by an electrical heating element),
- a detachable powder-chemical cartridge 171,
- a chemical-dosing trigger 3601,
- a chemical-dosing system (such as a pump, not shown) and the required tubes,
- a chemical-dosing nozzle 3602,
- a detachable and refillable water tank 3603 for holding water used for both rinsing and powder dissolution,
- a rinsing pump to supply water, not shown,
- a rinsing-pump trigger 3604,
- a rinsing-water nozzle 3605,
- an optional brush (manual or electromechanical-motor brush), not shown,
- a temperature switch 3606, and
- a temperature-indicator light 3607.

It is noted that the term powder may either refer to non-aggregated powder particles, or aggregated powder particles equivalent to forming a solid chemical.

The usage of this device can be classified into the three main processes stain removal, rinsing and drying. These processes occur as the listed order.

To begin the stain-removal process, the liquid-chemical cartridge (or alternatively the powder-chemical capsule/pouch) is coupled to the device.

Figure 25:
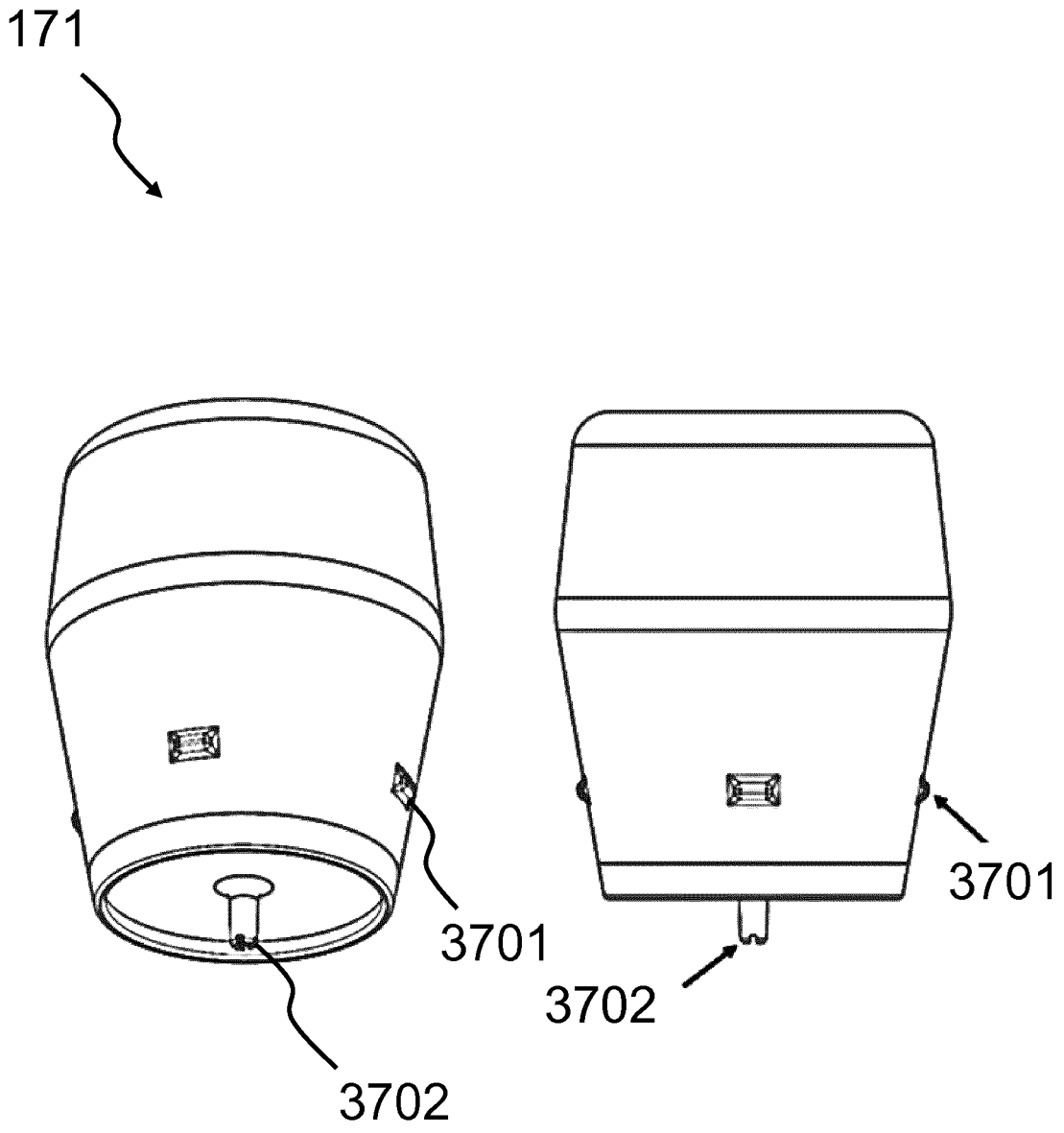
FIG. 25 depicts an example of a liquid-chemical cartridge according to the invention.

FIG. 25 depicts an example of a detachable stain removal accessory 171 according to the invention taking the form of a liquid-chemical cartridge.

The cartridge is intended to be coupled to the device by at least one locking stud 3701.

Alternatively, screw threads (not shown) may be present on both the cartridge and device to enable the cartridge to be screwed into the device.

The cartridge comprises an outlet 3702 to let the liquid chemical exit the cartridge for stain treatment.

The outlet may comprise a valve mechanism (not shown) that opens only when coupled to the device.

Alternatively (not shown), the liquid-chemical cartridge is perforated, for example by a hollow needle or a pin arranged in the device, when coupled to the device.

Alternatively (not shown), the liquid-chemical cartridge comprises a removable cover (for example made of aluminum) that can be peeled off by the user before the cartridge is placed in the device. In that case, the stain removal device comprises a cover system (not shown) intended to cover the uncovered outlet and allow liquid chemical to exit the cartridge for stain treatment.

The detachable liquid-chemical cartridge may be in the form of a hard or semi-soft container containing liquid chemical, with an outlet for the liquid chemical.

A liquid-chemical cartridge is intended to be used one time or multiple times. For example, the volume of liquid-chemical contained can range between 50 cc and 150 cc.

Figure 3:
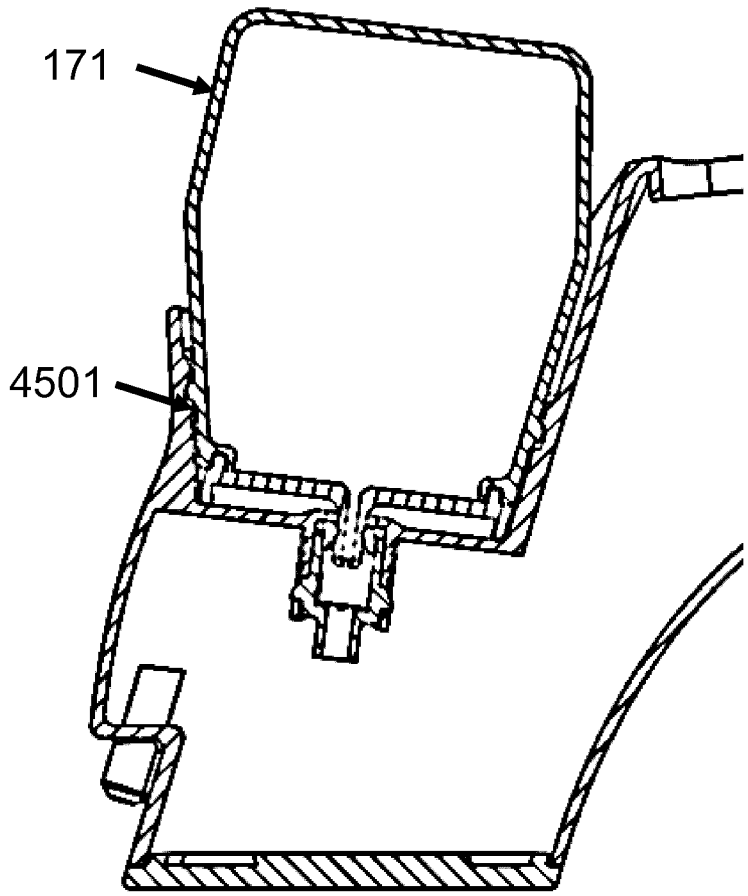
FIG. 3 depicts an example of placement of a liquid-chemical cartridge in a device according to the invention.

FIG. 3 depicts an example of placement in a device of a detachable stain removal accessory 171 according to the invention taking the form of a liquid-chemical cartridge 171.

The device cavity 4501 into which the cartridge locks has an outlet that allows liquid chemical to pass from the cartridge to the device interior.

Figure 1:
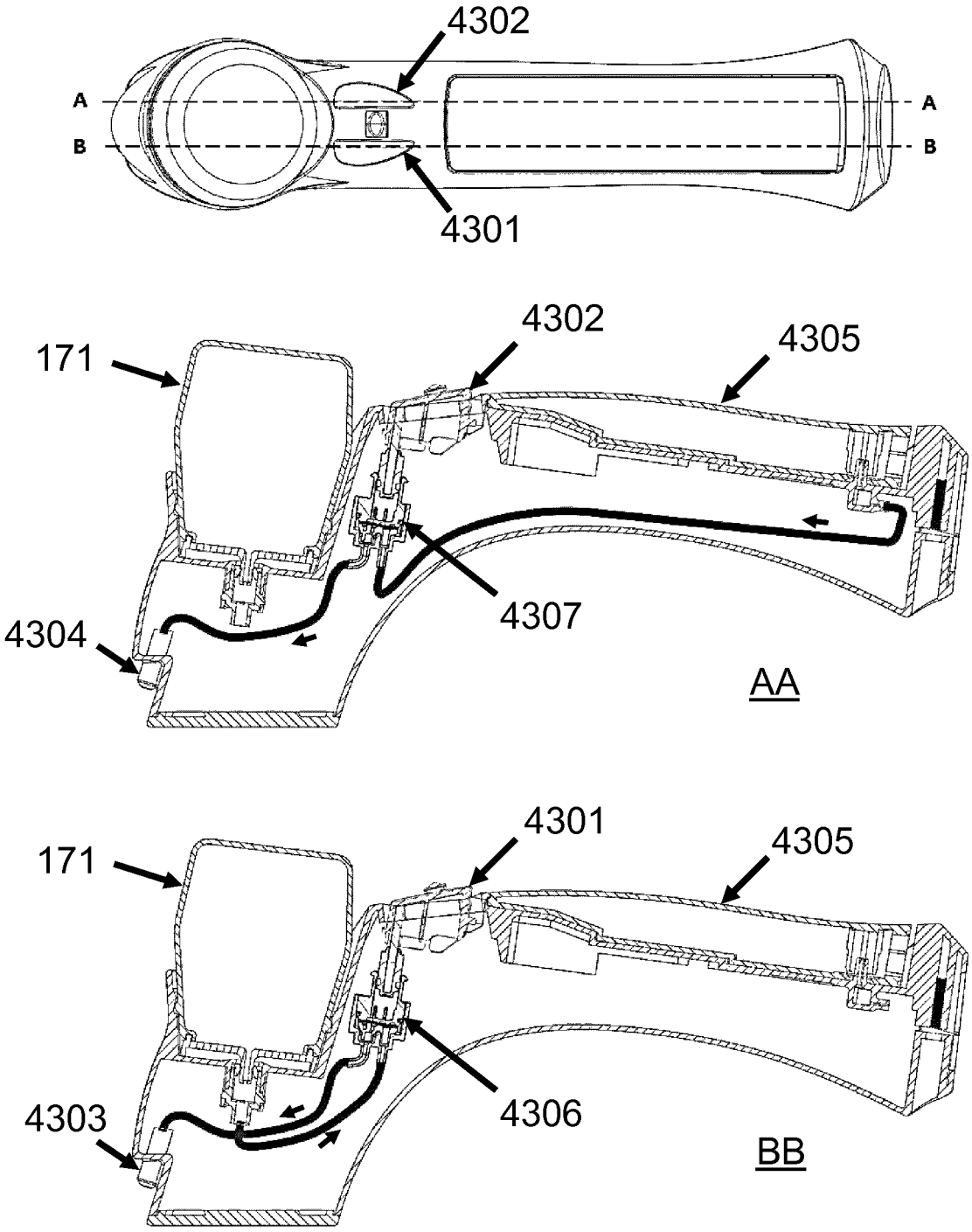
FIG. 1 depicts an example of tube arrangement and fluid flow in a device according to the invention using a liquid-chemical cartridge.

FIG. 1 depicts an example of tube arrangement and fluid flow in a device according to the invention using a liquid-chemical cartridge 171.

The device comprises:

- a chemical-dosing trigger 4301,
- a rinsing-pump trigger 4302,
- a chemical-dosing nozzle 4303,
- a rinsing-water nozzle 4304,
- a detachable and refillable water tank 4305 for holding water used for both rinsing and powder dissolution,
- a chemical-dosing pump 4306, and the required tubes,
- a rinsing pump 4307 to supply water, and the required tubes.

There are two fluid flow paths when the device employs a liquid-chemical cartridge:

- a liquid-chemical flow path, and
- a water flow path.

In the liquid-chemical flow path, the liquid chemical flows from the liquid-chemical cartridge 171 to the chemical-dosing pump to the chemical-dosing nozzle.

In the water flow path, water flows from the water tank to the rinsing pump to the rinsing-water nozzle.

Figure 26:
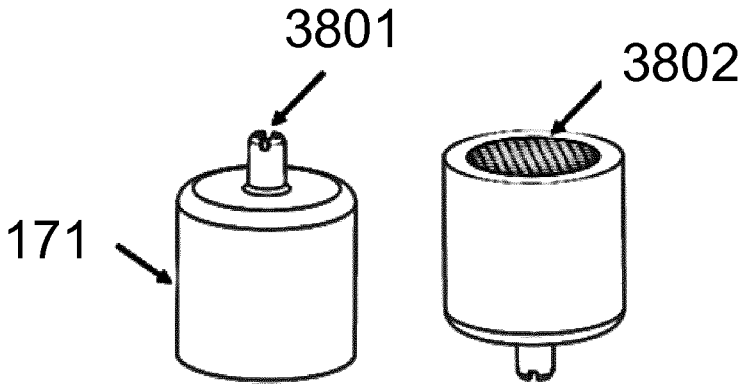
FIG. 26 depicts an example of a powder-chemical cartridge according to the invention.

FIG. 26 depicts an example of a detachable stain removal accessory (171) according to the invention taking the form of a powder-chemical cartridge 171.

The cartridge is attached to the stain removal device by placing it into a cavity in the device and closing the cavity, for example by a hinged enclosure (not shown).

The hinged enclosure closes the cavity and locks to the device via at least one locking stud. Besides securing the powder-chemical cartridge in the device, the enclosure also serves to supply water to the cartridge from the water tank.

The cartridge comprises an inlet 3801 to allow water to enter the cartridge and dissolve the powder chemical.

Figure 27:
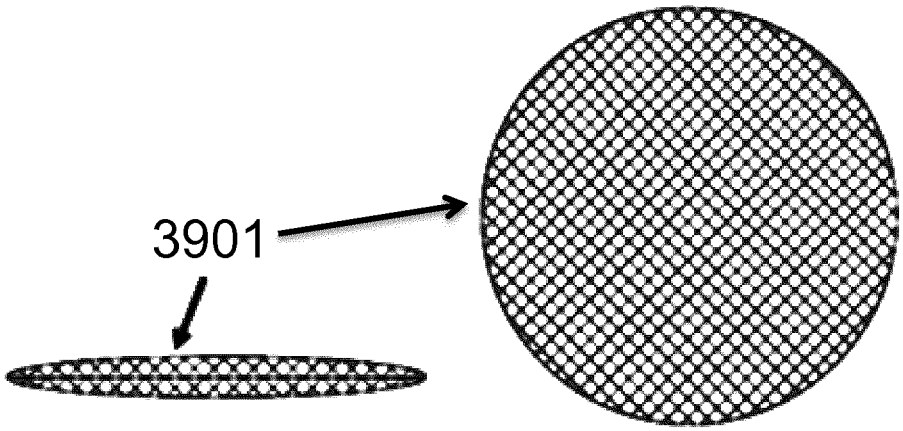
FIG. 27 depicts an example of a soft, flexible and porous powder-chemical pouch according to the invention.

The cartridge also comprises a porous outlet 3802 for the dissolved-powder chemical solution. Alternatively, the entire cartridge may be a soft, flexible and porous pouch containing the chemical powder. The porous material should have a pore size smaller than the grain size of the chemical powder. An example of such a flexible and porous pouch 3901 is illustrated in FIG. 27.

Alternatively, a solid-chemical block or pill can be used instead of a powder chemical on the condition that the solid chemical can be dissolved by water.

The detachable powder-chemical cartridge may be in the form of a hard or semi-soft capsule containing chemical powder.

A powder-chemical cartridge is preferably intended for single use. Indeed, the diluted powder does not have a long life-duration in terms of efficiency to treat stains.

Figure 4:
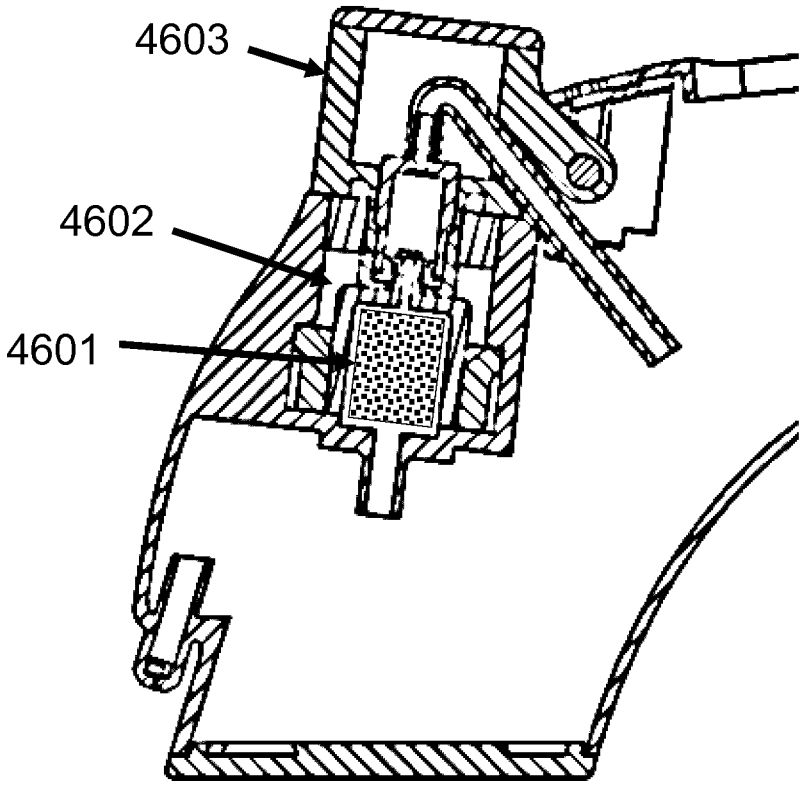
FIG. 4 depicts an example of placement of a powder-chemical cartridge in a device according to the invention.

FIG. 27 depicts an example of a soft, flexible and porous powder-chemical pouch 3901 according to the invention FIG. 4 depicts an example of placement of a detachable stain removal accessory taking the form of a powder-chemical capsule in a device according to the invention.

The powder-chemical capsule 4601 is placed in a cavity 4602 closed by an enclosure 4603.

Figure 5:
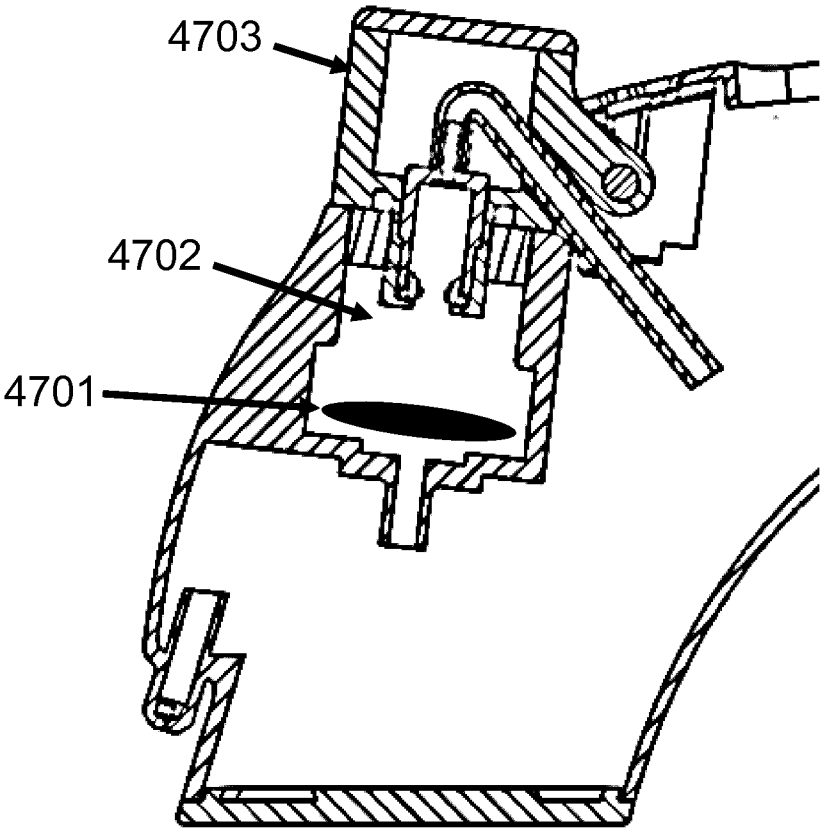
FIG. 5 depicts an example of placement of a powder-chemical pouch in a device according to the invention.

FIG. 5 depicts an example of placement of a detachable stain removal accessory taking the form of a powder-chemical pouch in a device according to the invention.

The powder-chemical pouch 4701 is placed in a cavity 4702 closed by an enclosure 4703.

Figure 6:
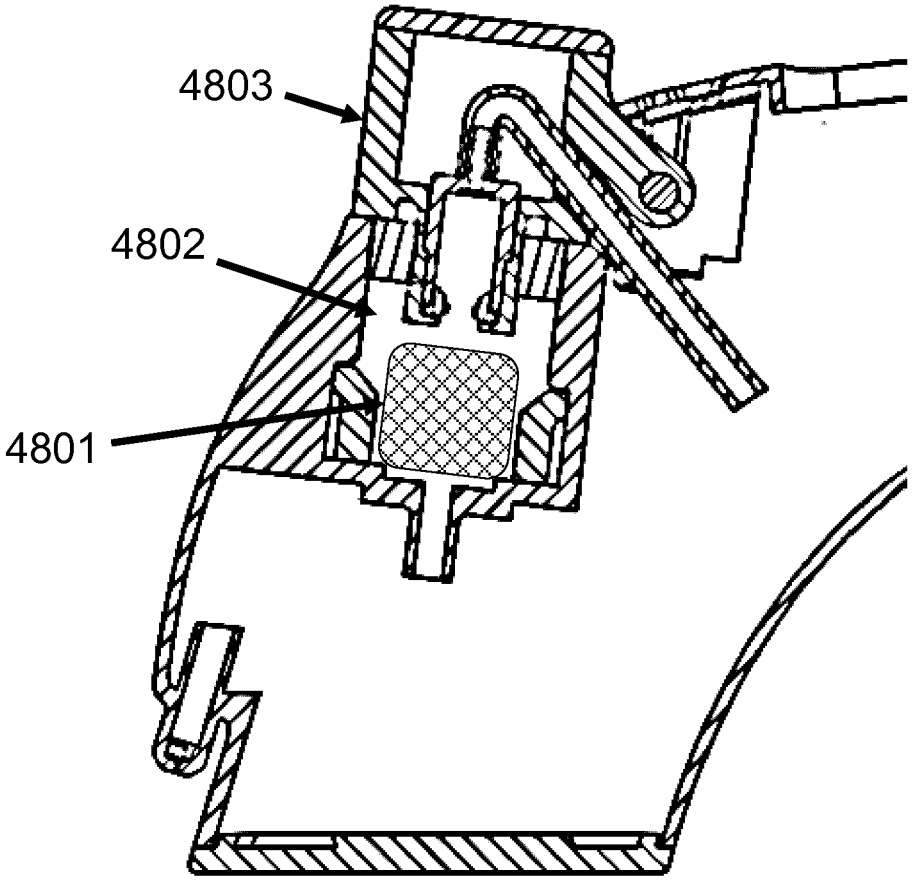
FIG. 6 depicts an example of placement of a solid-chemical pill in a device according to the invention.

FIG. 6 depicts an example of placement of a detachable stain removal accessory taking the form of a solid-chemical pill in a device according to the invention.

The solid-chemical pill 4801 is placed in a cavity 4802 closed by an enclosure 4803.

Figure 7:
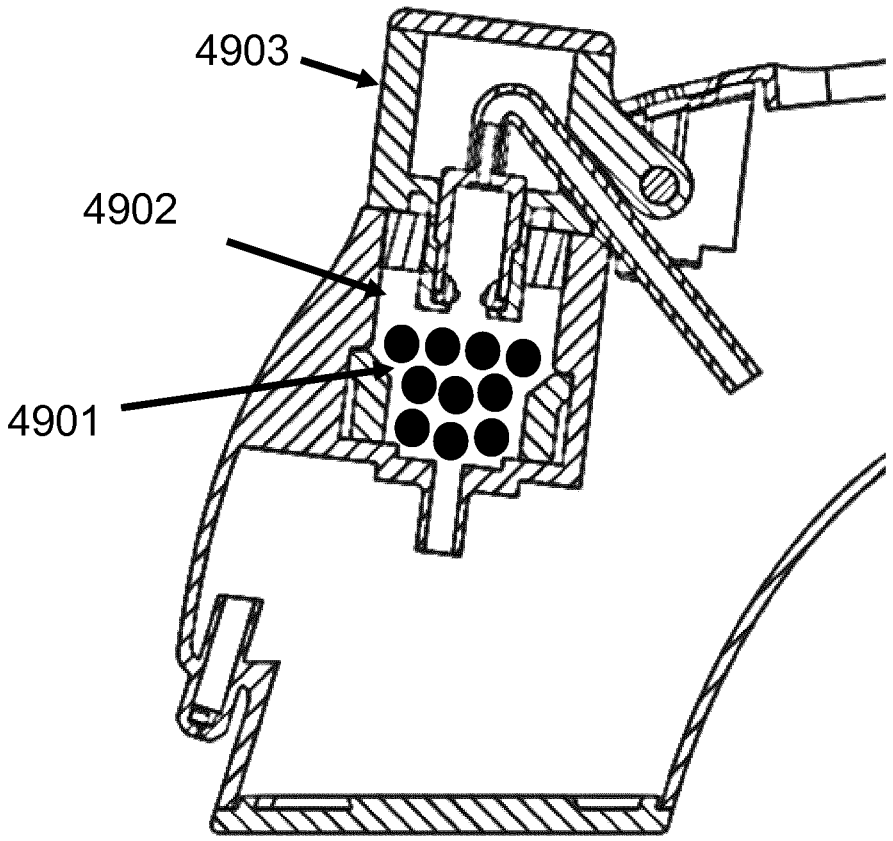
FIG. 7 depicts an example of placement of solid-chemical granules in a device according to the invention.

FIG. 7 depicts an example of placement of a detachable stain removal accessory taking the form of solid-chemical granules in a device according to the invention.

The solid-chemical granules 4901 is placed in a cavity 4902 closed by an enclosure 4903.

The device cavity into which the cartridge is placed has an outlet that allows chemical solution to pass from the cartridge to the device interior. Irrespective of the form factor of the powder-chemical cartridge (powder-chemical capsule, powder-chemical porous pouch, solid-chemical pill, or solid-chemical granules), the cartridge is coupled to the device by placing the cartridge in the device cavity and closing the cartridge enclosure. Also, irrespective of cartridge form factor, the powder or solid chemical is dissolved within the device cavity before the resultant chemical solution exits the cavity.

Figure 2:
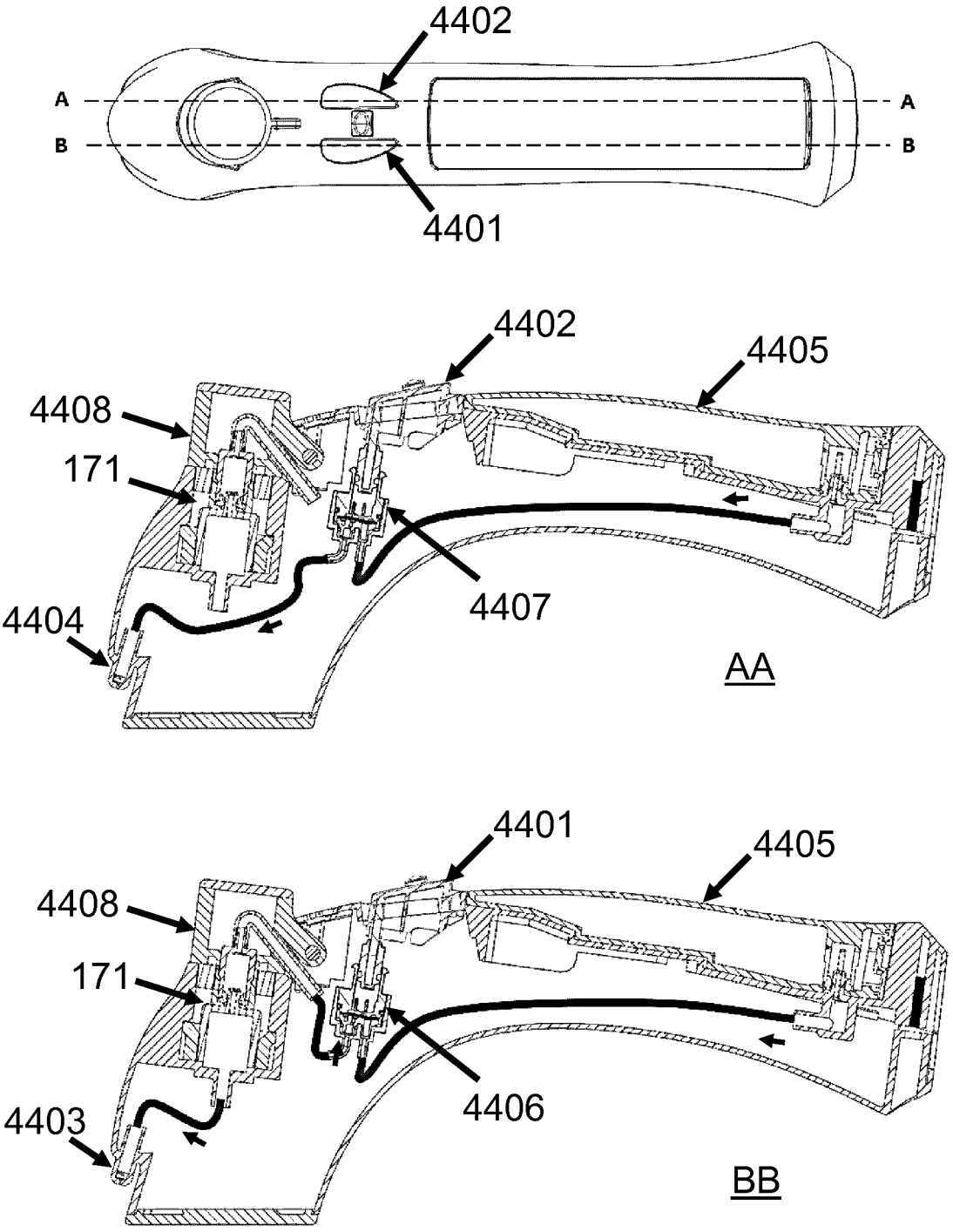
FIG. 2 depicts an example of tube arrangement and fluid flow in a device according to the invention using a powder-chemical cartridge.

FIG. 2 depicts an example of tube arrangement and fluid flow in a device using a detachable stain removal accessory 171 taking the form of a powder-chemical cartridge.

The device comprises:

- a chemical-dosing trigger 4401,
- a rinsing-pump trigger 4402,
- a chemical-dosing nozzle 4403,
- a rinsing-water nozzle 4404,
- a detachable and refillable water tank 4405 for holding water used for both rinsing and powder dissolution,
- a chemical-dosing pump 4406, and the required tubes,
- a rinsing pump 4407 to supply water, and the required tubes,
- an enclosure 4408 for the cartridge.

There are two fluid flow paths when the device employs a powder-chemical cartridge:

- a water and chemical hybrid flow path, and
- a water flow path.

In the water and chemical hybrid flow path, water flows from the water tank to the chemical-dosing pump to the cartridge enclosure to the powder-chemical cartridge, where it dissolves the powder chemical to form a chemical solution. The chemical solution then flows from the cartridge to the chemical-dosing nozzle.

In the water flow path, water flows from the water tank to the rinsing pump to the rinsing-water nozzle.

Note that the terms pod, capsule, pouch, pill, or equivalent can be used indifferently to designate the cartridge.

After the cartridge is coupled to the device, the heated plate is turned on to a first temperature setting (lower temperature), such that the heated plate reaches a temperature of at least 65° C. The optimal temperature is between 90° C. and 120° C., though a temperature range of 65° C. to 140° C. is also acceptable.

The liquid chemical is dosed onto the stained fabric by activating the chemical-dosing trigger. The chemical-dosing trigger is equivalent to a switch that activates the chemical-dosing pump to pump liquid chemical from the liquid-chemical cartridge to a chemical-dosing outlet near the heated plate.

Alternatively, the chemical-dosing trigger causes the chemical-dosing pump to pump water from the water tank to the powder-chemical capsule/pouch, dissolving the powder to form a chemical solution. The chemical-dosing pump then continues to pump the chemical solution (dissolved powder) from the powder capsule/pouch to the chemical-dosing nozzle. When the liquid chemical or chemical solution (dissolved powder) has been dispensed, the heated plate should be placed on the surface of the stained fabric to enable heating of the wetted fabric. The heat is optional, but can greatly enhance stain removal result and speed by accelerating the chemical reaction. Alternatively, heat can be applied through other forms of heating, such as hot air, steam, microwave and exothermic reaction.

Dosing and heating of the stained fabric should be repeated until the stain visibility has been reduced to an acceptable level.

Once the stain visibility has been reduced to a level that is acceptable by the user, the device will enter the second phase of stain removal, which is rinsing process.

In the rinsing phase, the rinsing-pump trigger is activated. Water is pumped from the water tank through the pump and out from a rinsing-water nozzle near the heated plate. This process dilutes the chemical and washes the fabric.

Figure 28:
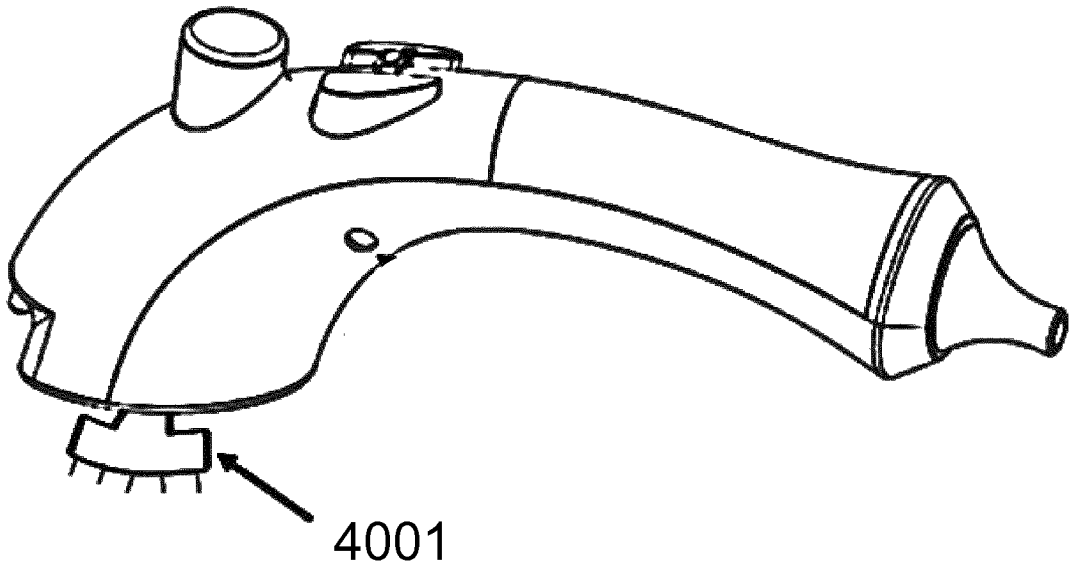
FIG. 28 depicts an example of a device according to the invention equipped with a brush.

FIG. 28 depicts an example of a device according to the invention equipped with a brush 4001.

The brush head (optionally motorized) is activated at the same time to provide optional mechanical scrubbing action to push the waste water out of the fabric.

Alternatively, the brush may be replaced by an accessory or feature (not shown) that is able to provide mechanical action, such as a tapping motion, a forward-backward linear motion or a circular motion.

Alternatively, a chemical neutralizer may be applied to neutralize the residual chemical.

When rinsing is completed, the user moves on to the third process, which is the drying process. This process is optional and does not affect the stain-removal process.

However, the drying process brings extra convenience to the user, such that the treated fabric can be used almost immediately without waiting for the fabric to dry. The temperature switch of the device is for example switched to the second temperature setting (higher temperature) to raise the temperature of the heated plate to approximately 150° C. which gives the optimal balance between drying speed and reduced risk of scorching fabric under treatment.

More generally, a temperature range of 100° C. to 170° C. is suitable for drying. The heated plate, which will be used for drying, should preferably be cleaned prior to the drying process. The heated plate is placed onto the rinsed fabric area to provide for localized drying, similar to the action of an electric iron. The process is completed upon drying of the fabric.

Alternatively, drying may be achieved through other means of providing heat or air movement, such as hot air, radiation, moving air or vacuum extraction.

Preferably, the device according to the invention comprises a heating unit (not shown) to heat the liquid (or diluted) chemical before being applied on the stained area. The goal is to accelerate the reaction. For example, the liquid (or diluted) chemical is heated to reach a value in the range of 30° C. to 100° C. The heating can be done via different approaches:

If dealing with a liquid-chemical cartridge, the heating unit is adapted to heat the cartridge directly, If dealing with a liquid-chemical cartridge, the heating unit is adapted to heat the liquid chemical after it leaves the cartridge and before it exits the chemical-dosing nozzle, If dealing with a powder-chemical cartridge, the heating unit is adapted to heat the dissolved-powder chemical solution after the chemical solution leaves the cartridge and before it exits the chemical-dosing nozzle, If dealing with a powder-chemical cartridge, the heating unit is adapted to heat water before dosing the heated water into the cartridge.

Figure 29:
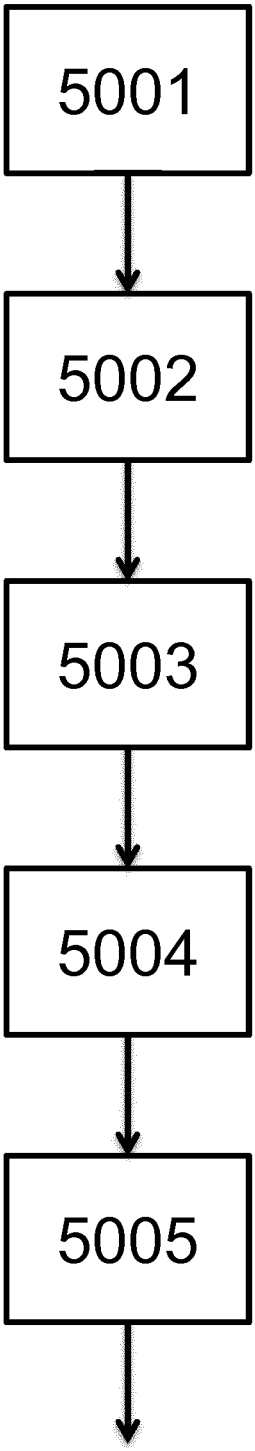
FIG. 29 depicts a flow chart of a method according to the invention of treating a stained area by a stain removal device.

FIG. 29 depicts a flow chart of a method according to the invention of treating a stained area by a stain removal device as described above.

The method comprises the steps of:

Coupling (5001) the detachable stain removal accessory (171) to said stain removal device, Dosing (5002) said chemical reagent in the form of a liquid on the stained area, Diffusing (5003) heat to said stained area.

Preferably, the method further comprises a step (5004) of rinsing the stained area.

Preferably, the method further comprises a step (5005) of drying the stained area.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A portable stain removal device for locally removing a stain on a fabric, comprising:

a chemical container for containing a chemical reagent;

a dispensing mechanism for dispensing the chemical reagent out of the chemical container onto the fabric through a front head;

a heating plate arranged at the front head of the device for heating the fabric when the front head contacts the fabric; and a heater arranged adjacent to the heating plate for heating the heating plate.

2. The portable stain removal device according to claim 1, wherein the heater further heats the chemical reagent in the chemical container.

3. The portable stain removal device according to claim 1, further comprising a liquid tank for containing water and/or a chemical neutralizer to be dispensed into the chemical container and/or onto the fabric.

4. The portable stain removal device according to claim 3, wherein the heater further heats the liquid tank to generate at least one of hot water, or hot chemical neutralizer or steam.

5. The portable stain removal device according to claim 1, wherein the chemical container comprises a cartridge detachable from the portable stain removal device.

6. The portable stain removal device according to claim 5, wherein the chemical reagent is a liquid chemical reagent contained in the detachable cartridge the portable stain removal device further comprising:

a chemical-dosing nozzle; and a pump for carrying the liquid chemical reagent from the detachable cartridge to the chemical-dosing nozzle in order to dispense the liquid chemical reagent onto the fabric.

7. The portable stain removal device according to claim 5, wherein the chemical reagent is a powder or granule contained in the detachable cartridge, the portable stain removal device further comprising:

a chemical-dosing nozzle;

a water tank for holding water; and a pump for carrying the water from the water tank to the detachable cartridge in order to form a chemical solution, and to carry the chemical solution from the detachable cartridge to the chemical-dosing nozzle.

8. The portable stain removal device according to claim 1, further comprising:

a water tank for holding water;

a rinsing-water nozzle; and a pump for carrying water from said water tank to said rinsing-water nozzle.

9. The portable stain removal device according to claim 5, further comprising a temperature switch for selecting one of a first temperature setting and a second temperature setting of the heating plate.

10. The portable stain removal device according to claim 9, wherein the temperature switch operates to select the first temperature setting to heat the heating plate to a first temperature after the detachable cartridge is attached to the portable stain removal device, wherein the first temperature is at least 65° C.

11. The portable stain removal device according to claim 10, wherein the first temperature is between 65° C. to 140° C.

12. The portable stain removal device according to claim 9, wherein the temperature switch operates to select the second temperature setting to heat the heating plate to a second temperature during a drying process of the fabric, wherein the second temperature is in a range of 100° C. to 170° C.

13. A method of treating a stained area of a fabric with portable stain removal device comprising a detachable cartridge containing a chemical reagent, a dispensing mechanism, a heating plate arranged at a front head of the device, and a heater, the method comprising:

heating the heating plate using the heater thermally connected to the heating plate;

coupling the detachable cartridge to the portable stain removal device;

dosing the chemical reagent in the form of a liquid from the detachable cartridge onto the stain area of the fabric through the front head using the dispensing mechanism; and diffusing heat to the stained area via the heating plate, with a temperature of at least 65° C. when the front head is in contact with the fabric.

14. The method according to claim 13, further comprising rinsing with water and/or a chemical neutralizer the stained area.

15. The method according to claim 13, further comprising drying the stained area, by diffusing heat to the stained area via the heating plate, with a temperature in the range 100° C. to 170° C.

16. The method according to claim 13, further comprising heating the chemical reagent in the detachable cartridge using the heater.

17. A portable stain removal device for locally removing a stain on a fabric, comprising:

a chemical container for containing a chemical reagent;

a dispenser for dispensing the chemical reagent out of the chemical container onto the fabric through a front head;

a heating plate arranged at the front head of the device for heating the fabric when the front head contacts the fabric; and a heater arranged for heating the chemical reagent in the chemical container.

18. The portable stain removal device according to claim 17, wherein the chemical container comprises a cartridge detachable from the portable stain removal device.

19. The portable stain removal device according to claim 18, wherein the chemical reagent is a liquid chemical reagent contained in the detachable cartridge, the portable stain removal device further comprising:

a chemical-dosing nozzle; and a pump for carrying the liquid chemical reagent from the detachable cartridge to the chemical-dosing nozzle in order to dispense the liquid chemical reagent onto the fabric.

20. The portable stain removal device according to claim 18, wherein the chemical reagent is a powder or granule contained in the detachable cartridge, the portable stain removal device further comprising:

a chemical-dosing nozzle;

a water tank for holding water; and a pump for carrying the water from the water tank to the detachable cartridge in order to form a chemical solution, and to carry the chemical solution from the detachable cartridge to the chemical-dosing nozzle.

* * * * *